US011766110B2

(12) United States Patent
Nakada

(10) Patent No.: US 11,766,110 B2
(45) Date of Patent: Sep. 26, 2023

(54) APPLICATOR

(71) Applicant: MITSUBISHI PENCIL COMPANY, LIMITED, Tokyo (JP)

(72) Inventor: Jun Nakada, Fujioka (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 0 days.

(21) Appl. No.: 17/437,463

(22) PCT Filed: Mar. 13, 2020

(86) PCT No.: PCT/JP2020/011267
§ 371 (c)(1),
(2) Date: Sep. 9, 2021

(87) PCT Pub. No.: WO2020/189584
PCT Pub. Date: Sep. 24, 2020

(65) Prior Publication Data

US 2022/0183441 A1 Jun. 16, 2022

(30) Foreign Application Priority Data

Mar. 15, 2019 (JP) ..... 2019-048441
Oct. 8, 2019 (JP) ..... 2019-185226

(51) Int. Cl.
*A45D 34/04* (2006.01)
*A45D 34/00* (2006.01)

(52) U.S. Cl.
CPC ..... *A45D 34/04* (2013.01); *A45D 2034/002* (2013.01); *A45D 2034/005* (2013.01); *A45D 2200/055* (2013.01)

(58) Field of Classification Search
CPC ..... A45D 34/04; A45D 2034/002; A45D 2034/005; A45D 2200/055; B43K 5/18;
(Continued)

(56) References Cited

U.S. PATENT DOCUMENTS 5,871,296 A 2/1999 Furukawa
6,331,084 B1 12/2001 Ohba
(Continued)

FOREIGN PATENT DOCUMENTS

DE 760854 C 9/1952
EP 1559576 A2 8/2005
(Continued)

OTHER PUBLICATIONS

International Search Report for corresponding Application No. PCT/JP2020/011267, dated Jun. 9, 2020.
(Continued)

*Primary Examiner* — David J Walczak
(74) *Attorney, Agent, or Firm* — Renner, Otto, Boisselle & Sklar, LLP

(57) ABSTRACT

An applicator which comprises an application body arranged inside the front part of a barrel cylinder supplying the application body with the application liquid stored in a storage portion in the barrel cylinder, and is configured such that: a full coupling portion and a temporary coupling portion are formed on each of a front barrel and the barrel cylinder; the front barrel and the barrel cylinder each have an anti-rotation rib; the anti-rotation ribs are not engaged with each other in the initial coupled state before the temporary coupled state in which the temporary coupling portions of the barrel cylinder and the front barrel are engaged with each other; and, the anti-rotation ribs become engaged with each other in the fully coupled state in which the full coupling portions are engaged with each other.

8 Claims, 20 Drawing Sheets

(58) Field of Classification Search
CPC ... B43K 5/1818; B43K 5/1827; B43K 5/1845
USPC ..... 401/171–175, 117
See application file for complete search history.

(56) References Cited

U.S. PATENT DOCUMENTS

| | | | | |
|---|---|---|---|---|
| 2002/0070247 | A1* | 6/2002 | Kageyama ..... | A45D 34/042 222/391 |
| 2012/0077145 | A1 | 3/2012 | Hamada | |
| 2012/0141189 | A1 | 6/2012 | Nakajima | |
| 2012/0328354 | A1* | 12/2012 | Koyama ..... | A45D 34/042 401/179 |
| 2017/0087922 | A1 | 3/2017 | Dorpmund | |

FOREIGN PATENT DOCUMENTS

| | | | |
|---|---|---|---|
| GB | 2237506 | A | 5/1991 |
| JP | 61-124210 | U | 8/1986 |
| JP | 3-61967 | U | 6/1991 |
| JP | 8-230373 | A | 9/1996 |
| JP | 9-118096 | A | 5/1997 |
| JP | 11-187930 | A | 7/1999 |
| JP | 2000-312854 | A | 11/2000 |
| JP | 2004-114382 | A | 4/2004 |
| JP | 2005-59367 | A | 3/2005 |
| JP | 2006-55233 | A | 3/2006 |
| JP | 2009-254419 | A | 11/2009 |
| JP | 2011-194820 | A | 10/2011 |
| JP | 2012-157611 | A | 8/2012 |
| WO | 2010/140660 | A1 | 12/2010 |
| WO | 2011/027788 | A1 | 3/2011 |

OTHER PUBLICATIONS

Extended European Search Report for corresponding European Application No. EP 20 77 3233 dated Oct. 20, 2022.

* cited by examiner

APPLICATOR

TECHNICAL FIELD

The present invention relates to an applicator for applying ink or a liquid cosmetic such as eyeliner, more specifically, relating to an applicator, which holds back the supply of a fluid to the applying part in a state before the start of use, e.g., when it is stored or during sale, and which allows for conduction of the fluid cosmetic to the applying part when used by a user.

BACKGROUND ART

Conventionally, various applicators with an applying part provided in a front barrel at the front part of a barrel cylinder that stores a cosmetic, have been proposed (see Patent Document 1).

In an applicator described in Patent Document 1, a stopper formed in a ring shape has been set (temporary coupled) so that the application liquid will not come to the applying part when the applicator is virgin. When it starts to be used, the user removes the stopper and squeezes the front barrel into the barrel cylinder so as to supply the application liquid stored in the barrel body to the applying part, enabling application.

There has been a proposal of a push-type applicator that converts a pushing action into a rotary action to feed out an application liquid (see Patent Document 2).

Since this applicator has a cam surface formed on the endface of a cylindrical rotating body, there is a limit to the feeding force. When the application liquid is oil-based, the viscosity is high, so that the applicator of Patent Document 2 is not suitable for feeding out the application liquid.

Further, Patent Document 3 proposes an applicator capable of increasing the feeding force by use of a guide slot and a protrusion.

PRIOR ART DOCUMENT

Patent Documents

Patent Document 1:

Japanese Patent Application Laid-open No. 2012-157611

Patent Document 2:

Japanese Patent Application Laid-open No. 2009-254419

Patent Document 3:

Japanese Patent Application Laid-open No. 2011-194820

SUMMARY OF INVENTION

Problems to be Solved by the Invention

In the applicator of Patent Document 1, in order to press-fit the front barrel, the user does not need to position the front barrel as long as the stopper is taken out and the front barrel is squeezed without its removal from the barrel cylinder. However, if the user mistakenly removes the front barrel from the barrel cylinder, removes the stopper from the barrel cylinder, and then tries to attach the front barrel to the barrel cylinder, there is a risk of the liquid leaking due to an insufficient press-fitting between the front barrel and the barrel cylinder if the front barrel is not set in place, and it is difficult for a user to position and fit the front barrel to the barrel cylinder without causing liquid leakage.

Since the applicator has a plurality of axial parts, work processes for aligning the longitudinal positions of the axial parts are required during manufacture of the applicator, resulting in a workload. However, no technology has been proposed that reduces the workload of this kind.

In view of the above circumstances, it is an object of the present invention to provide an applicator which temporarily couples a front barrel and a barrel cylinder using a stopper ring, and enables easy positioning at the time of coupling.

Another object of the invention is to provide an applicator that can improve the assembly workability during manufacture.

Means for Solving Problems

The present invention is an applicator which comprises: a barrel cylinder in which an application liquid is stored in a storage portion inside the rear part thereof; and an applying part arranged inside the front part of the barrel cylinder and supplies the applying part with the application liquid stored in the storage portion in the barrel cylinder, characterized in that:

a full coupling portion and a temporary coupling portion are formed on each of a front barrel and the barrel cylinder;

the front barrel and the barrel cylinder each has an anti-rotation rib;

the anti-rotation ribs are not engaged with each other in the initial coupled state before the temporary coupled state in which the temporary coupling portions of the barrel cylinder and the front barrel are engaged with each other; and, the anti-rotation ribs become engaged with each other in the fully coupled state in which the full coupling portions are engaged with each other.

In the present invention, it is preferable that a temporary coupling portion is formed on the applying part side of the full coupling portion of the barrel cylinder.

In the present invention, it is preferable that the barrel cylinder is formed with an anti-rattling portion that radially supports the front barrel from the inside, at least, at the time of either the initial coupled state or the temporary coupled state.

In the present invention, it is further preferable that the full coupling portion has different outside diameters at the front side and the rear side thereof.

In the present invention, it is preferable that the applicator further comprises: a piston that slides inside the storage portion; a screw shaft threaded on the peripheral surface thereof; a propelling body for a propelling operation; a rotary cam body; and a transmission cam body, wherein a threaded portion mating the screw shaft is provided in the rear of the storage portion, the rotary cam is turned by a propelling operation to the propelling body so as to relatively rotate the screw shaft and the threaded portion to thereby advance the screw shaft, which in turn advances the piston to supply the application liquid stored in the storage portion, and is characterized in that at least one of the screw shaft, the rotary cam body, and the transmission cam body is formed symmetrically with respect to the front-rear direction.

In the present invention, it is preferable that a screw body formed with the threaded portion for accommodating the rotary cam body, the transmission cam body and the propelling body, has an inclined surface whose diameter increases from the rear end toward the front, formed on the inner surface thereof.

In the present invention, it is preferable that the relative rotation between the rotary cam body and the screw shaft is restricted; the transmission cam body rotates the rotary cam body by the propelling operation on the propelling body; the screw body formed with the threaded portion mating the screw shaft is provided in the rear of the storage portion; and, as the propelling body is operated, the rotary cam body rotates to advance the piston to supply the application liquid stored in the storage portion to the application body.

In the present invention, it is preferable that an oil-based cosmetic liquid is stored in the barrel cylinder, and the barrel cylinder is made of PBT.

In the present invention, it is preferable that a seal ball is fitted in the front end portion of the barrel cylinder via a seal joint, and in the fully coupled state, the seal ball is held in the storage portion of the barrel cylinder, and the seal joint in which the seal ball is fitted in, is formed with a projected portion projecting from the rear end opening thereof.

Effect of the Invention

According to the applicator of the present invention, in the initial coupled state before the temporary coupled state in which the temporary coupling portions of the barrel cylinder and the front barrel are engaged with each other, the anti-rotation ribs do not engage with each other. On the other hand, in the fully coupled state in which the full coupling portions are coupled with each other, the anti-rotation ribs become engaged with each other. Accordingly, the anti-rotation ribs will not interfere with each other in the initial coupled state, so that free positioning is acceptable, whereas in the temporary coupled state, the anti-rotation ribs can be mated with each other for proper positioning, and in the fully coupled state, the anti-rotation ribs can be inserted into each other, whereby it is possible to provide effective advantage that the front barrel can be positioned to the barrel cylinder with respect to the rotational direction.

Further, formation of at least one of the screw shaft, the rotary cam body, and the transmission cam body to be symmetrical with respect to the front-rear direction, it is possible to omit front and rear positioning, hence can provide excellency in improving assembly performance at manufacturing.

MODE FOR CARRYING OUT THE INVENTION

Now, an embodiment of the present invention will be described with reference to FIGS. 1 to 20.

Figure 1:
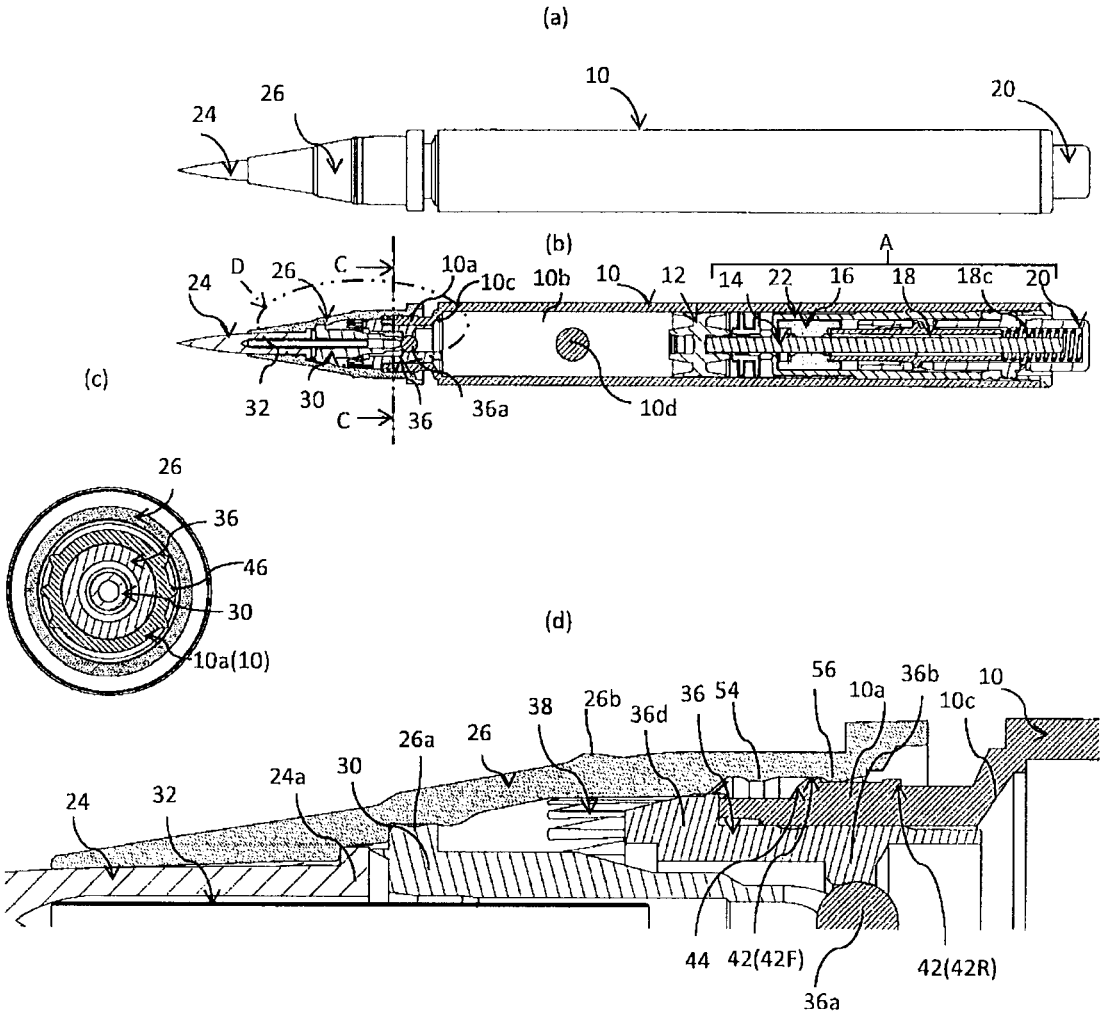
FIG. 1 Drawing of an applicator according to an embodiment of the present invention, illustrating an initial coupled state in which a stopper ring is removed from the applicator (ready-to-use state), (a) an overall side view, (b) an overall vertical section of (a), (c) a cross section of (b) cut along a line C-C, and (d) an enlarged illustrative view of a D portion in (b).
Figure 5:
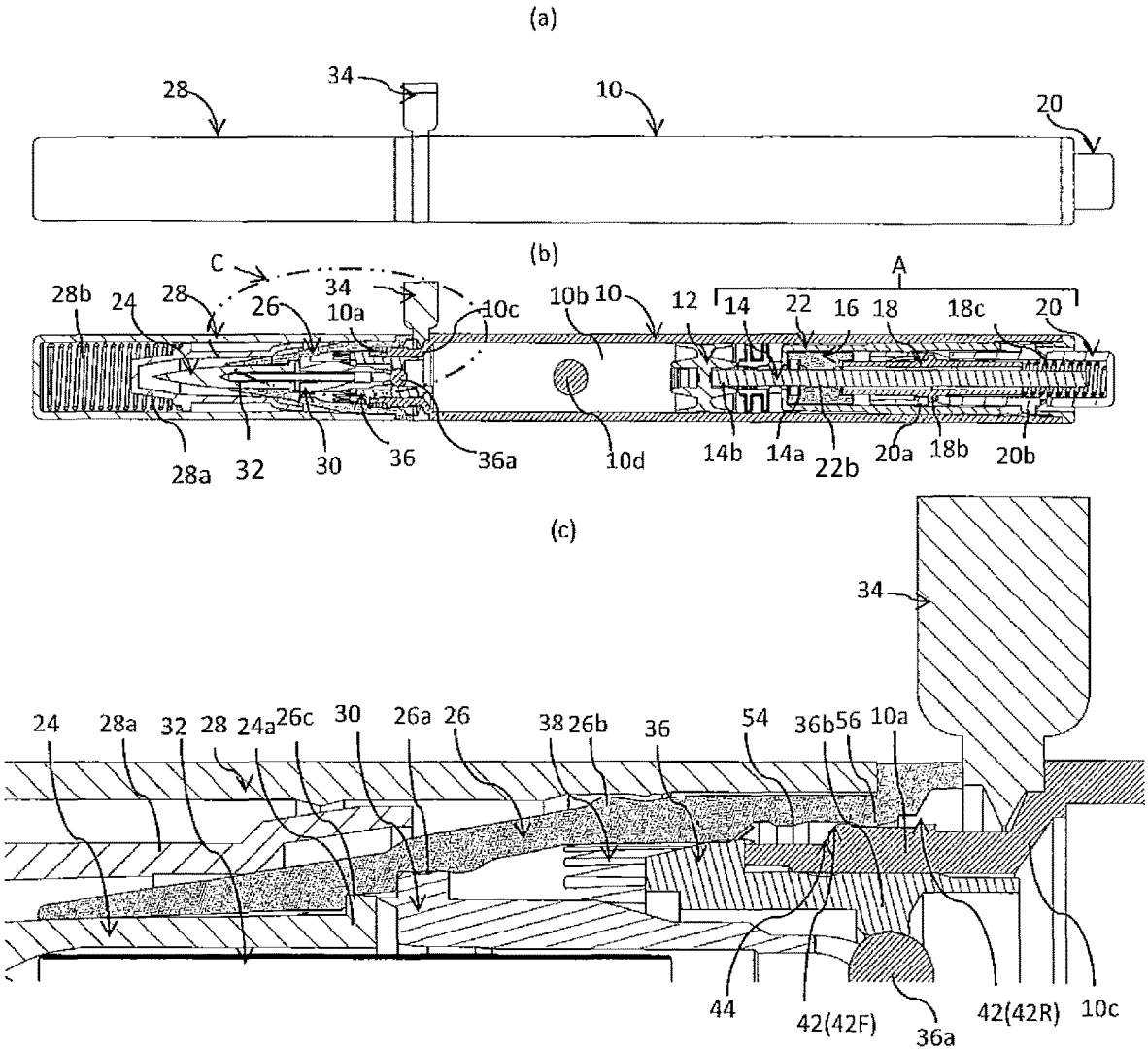
FIG. 5 Illustrative drawing of the applicator in FIG. 1, showing an initial coupled state (virgin state) of the front barrel and the barrel cylinder when the cap is fitted and a stopper ring is located in place, (a) an overall side view, (b) an overall vertical section, and (c) an enlarged illustrative view of a C portion in (b).
Figure 6:
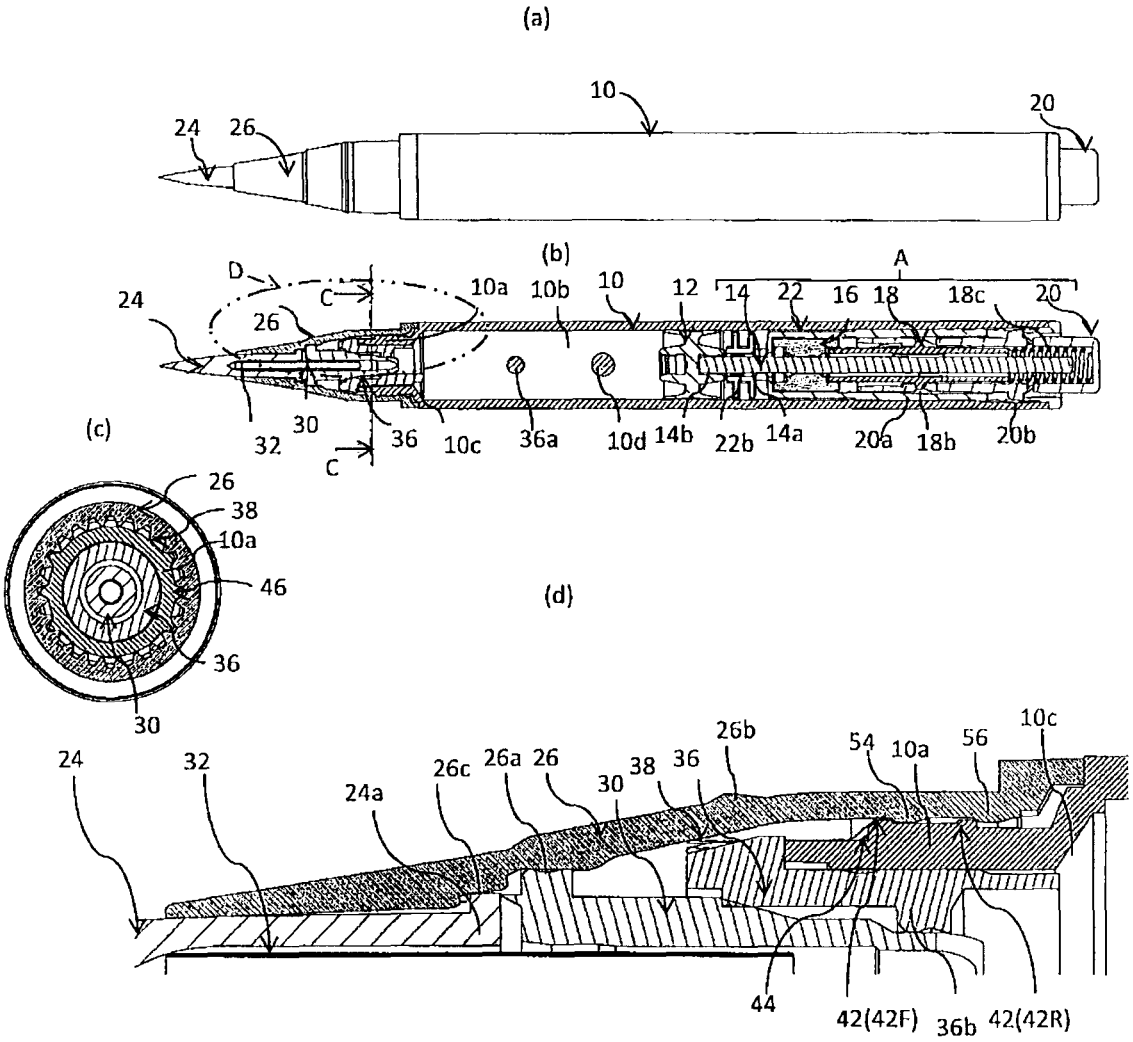
FIG. 6 Illustrative drawing of the applicator in FIG. 1, showing a fully coupled state of the front barrel to the barrel cylinder with the cap and a stopper ring removed, (a) an overall side view, (b) an overall vertical section, (c) a cross section cut along a line C-C in (b), and (d) an enlarged illustrative view of a D portion in (b).
Figure 7:
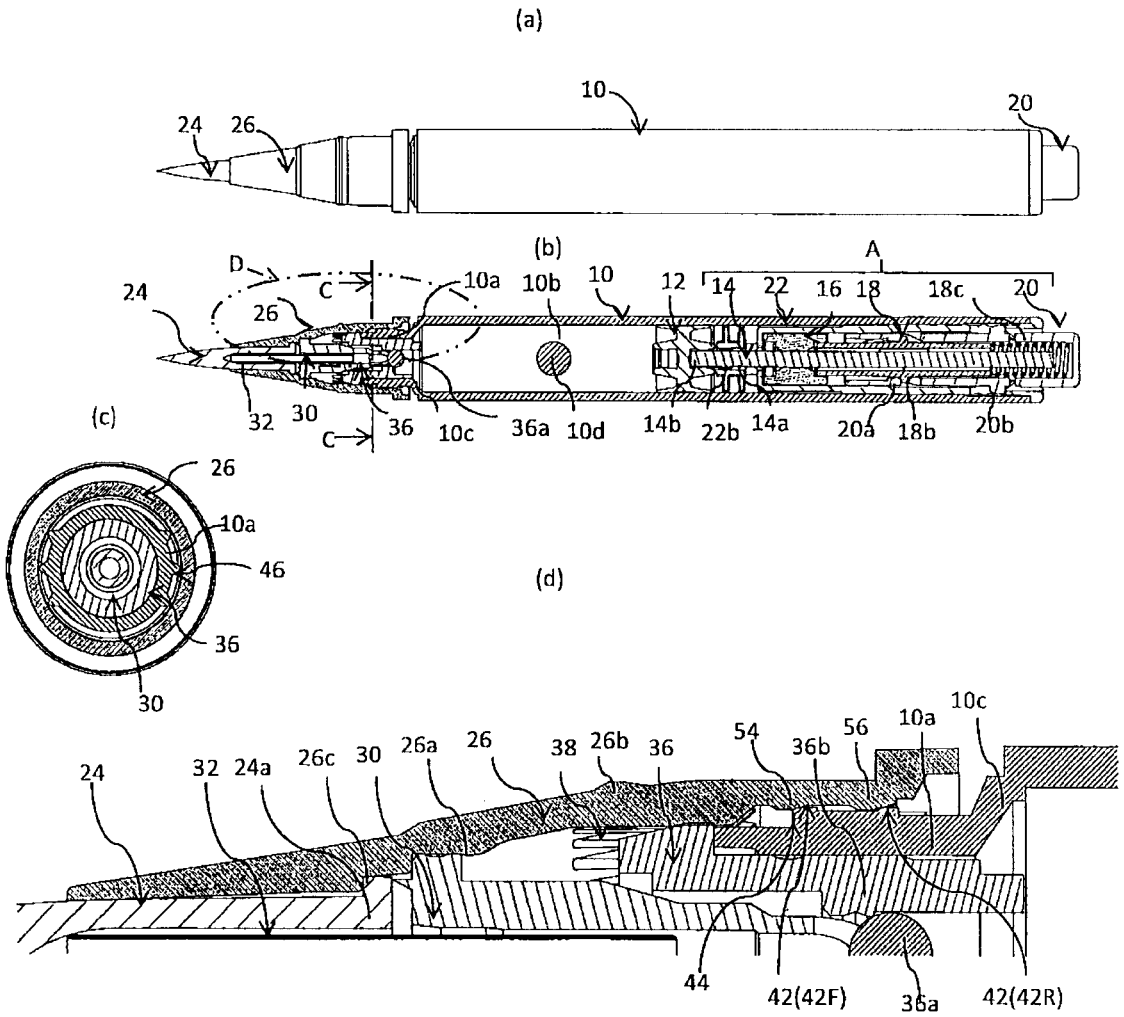
FIG. 7 Illustrative drawing of the applicator in FIG. 1, showing a temporary coupled state of the front barrel to the barrel cylinder with the cap and a stopper ring removed, (a) an overall side view, (b) an overall vertical section, (c) a cross section cut along a line C-C in (b), and (d) an enlarged illustrative view of a D portion in (b).
Figure 8:
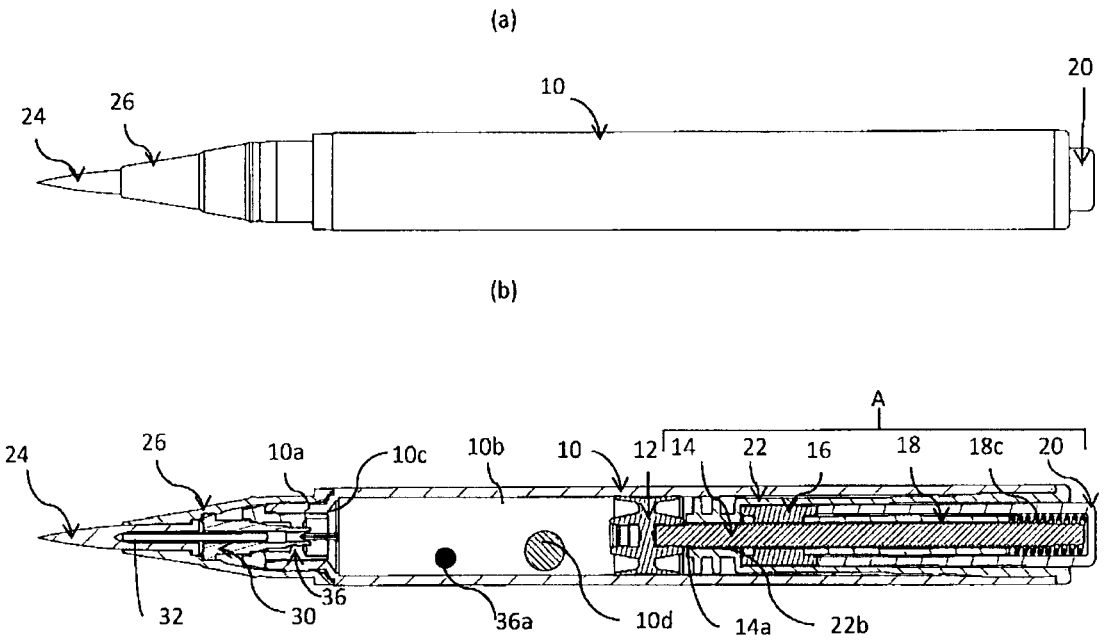
FIG. 8 Overall drawing of the applicator in FIG. 1, showing its pushed state during use, (a) a side view from one side, and (b) a vertical section.
Figure 9:
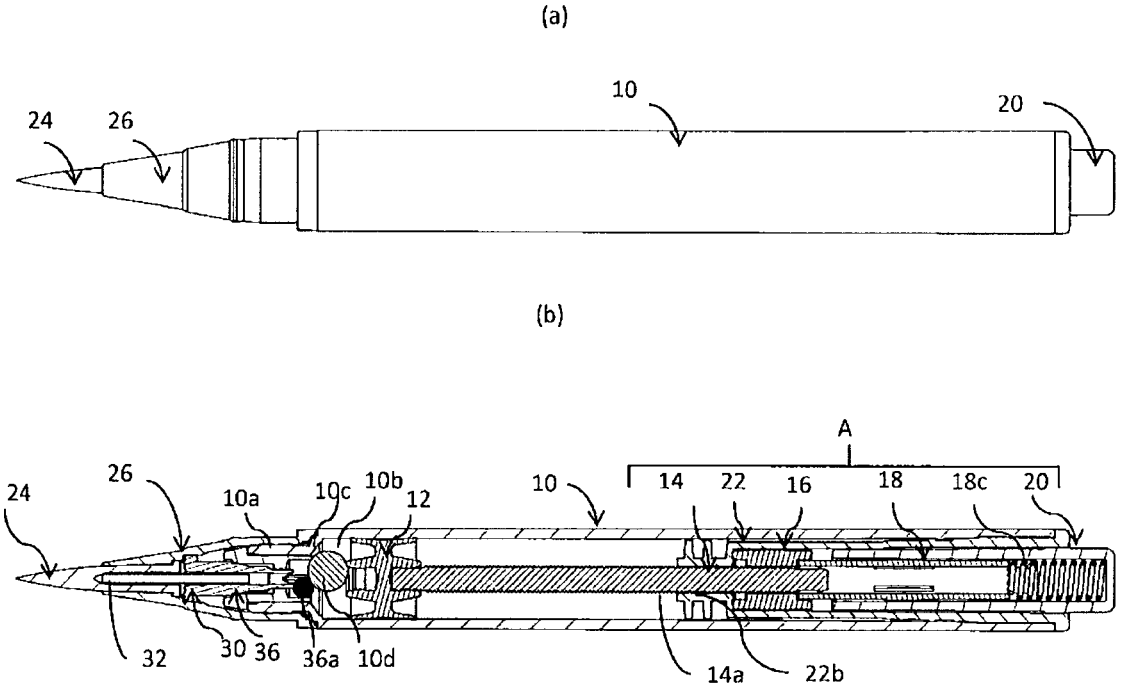
FIG. 9 Overall drawing of the applicator in FIG. 1, showing a state at the end of use, during use, (a) a side view from one side, and (b) a vertical section.

FIG. 1 shows a ready-to-use state and an initial coupled state in which a stopper ring 34 of the applicator according to the embodiment is removed. FIG. 5 shows an virgin state in which the stopper ring 34 of the applicator is attached. FIG. 6 shows a state in which the front barrel is fully coupled to the barrel cylinder at the start of use. FIG. 7 shows a state in which the front barrel is temporarily coupled to the barrel cylinder. FIG. 8 shows a pushed state at the start of use. FIG. 9 shows a state at the end of use.

As shown in FIG. 1 and others, in the applicator according to the embodiment, a storage portion 10*b* for storing an application liquid, a piston 12 that slides inside the storage portion 10*b*, and a screw shaft 14 having male threaded portions 14*a* on the peripheral surface thereof, are provided inside a barrel cylinder 10. A propelling body 20 for propelling operation is provided while a rotary cam body 16 whose rotation relative to the screw shaft 14 is restricted, a transmission cam body 18 that causes the rotary cam body 16 to rotate by the propelling operation on the propelling body 20, a screw body 22 having a threaded portion 22*b* mating with the screw shaft 14, are provided behind the storage portion 10*b*. As the propelling body 20 is operated, the rotary cam body 16 rotates and moves the piston 12 forward to supply the application liquid being stored in the storage portion 10*b* to the application body 24. In the applicator, the screw shaft 14 housed inside the screw body 22, the rotary cam body 16 and the transmission cam body 18 (examples of at least one item) are formed symmetrically with respect to the front-rear direction.

In the applicator, as shown in FIGS. 1 and 5 to 9, a propelling mechanism A including the screw body 22, the screw shaft 14, the rotary cam body 16, the transmission cam body 18, a spring 18*c* and the propelling body 20 is arranged in the barrel cylinder 10.

In the virgin state of the applicator, as shown in FIG. 5, a cap 28 and the stopper ring 34 are attached, and the stopper ring 34 has the front barrel 26 positioned in front thereof while a seal ball 36*a* is fitted in. At the start of use, as shown in FIG. 6, the stopper ring 34 is removed and the fully coupled state is created so that the seal ball 36*a* falls into the storage portion 10*b*. When pushed, the propelling body 20 is pressed as shown in FIG. 8, whereby the propelling body A moves the piston 12 forward. At the end of use, the piston 12 is located at the front end of the storage portion 10*b* as shown in FIG. 9.

Figure 2:
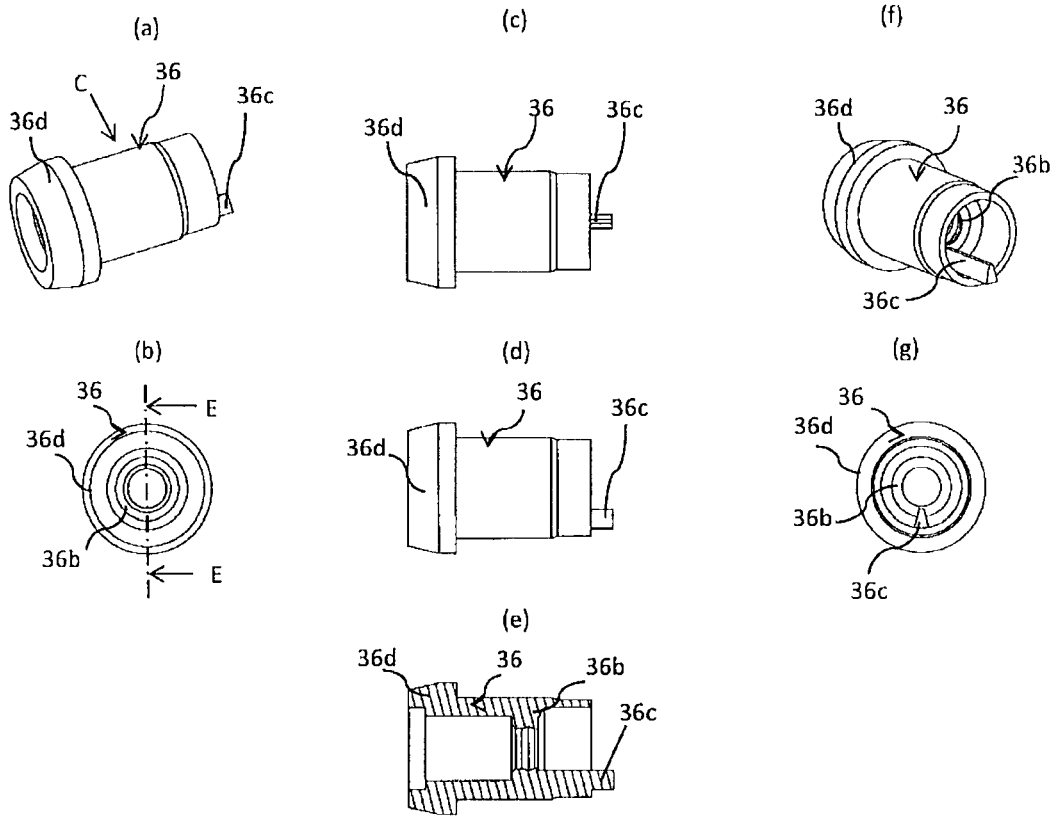
FIG. 2 Parts drawing of a seal joint (seal ball receiver) as a constituent in the applicator of FIG. 1, (a) a perspective view from the front, (b) a view seen from the front, (c) a side view seen in the direction of C in (a), (d) a side view of a state rotated 90 degrees from (c), (e) a vertical section cut along a line E-E in (b), (f) a perspective view from the rear, and (g) a view seen from the rear.
Figure 3:
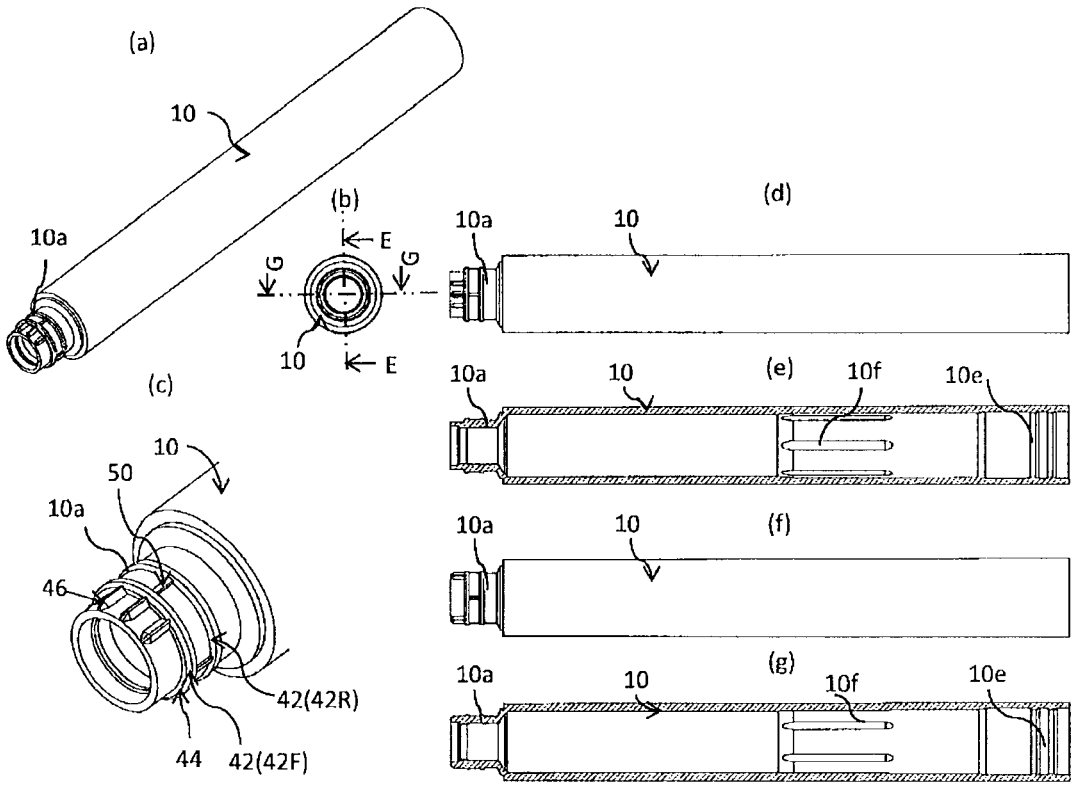
FIG. 3 Parts drawing of a barrel cylinder as a constituent in the applicator of FIG. 1, (a) a perspective view, (b) a view seen from the front, (c) a perspective view of the front end part enlarged, (d) a side view, (e) a vertical section cut along a line E-E in (b), (f) a side view of a state rotated 90 degrees from (d), and (g) a vertical section cut along a line G-G in (b).
Figure 4:
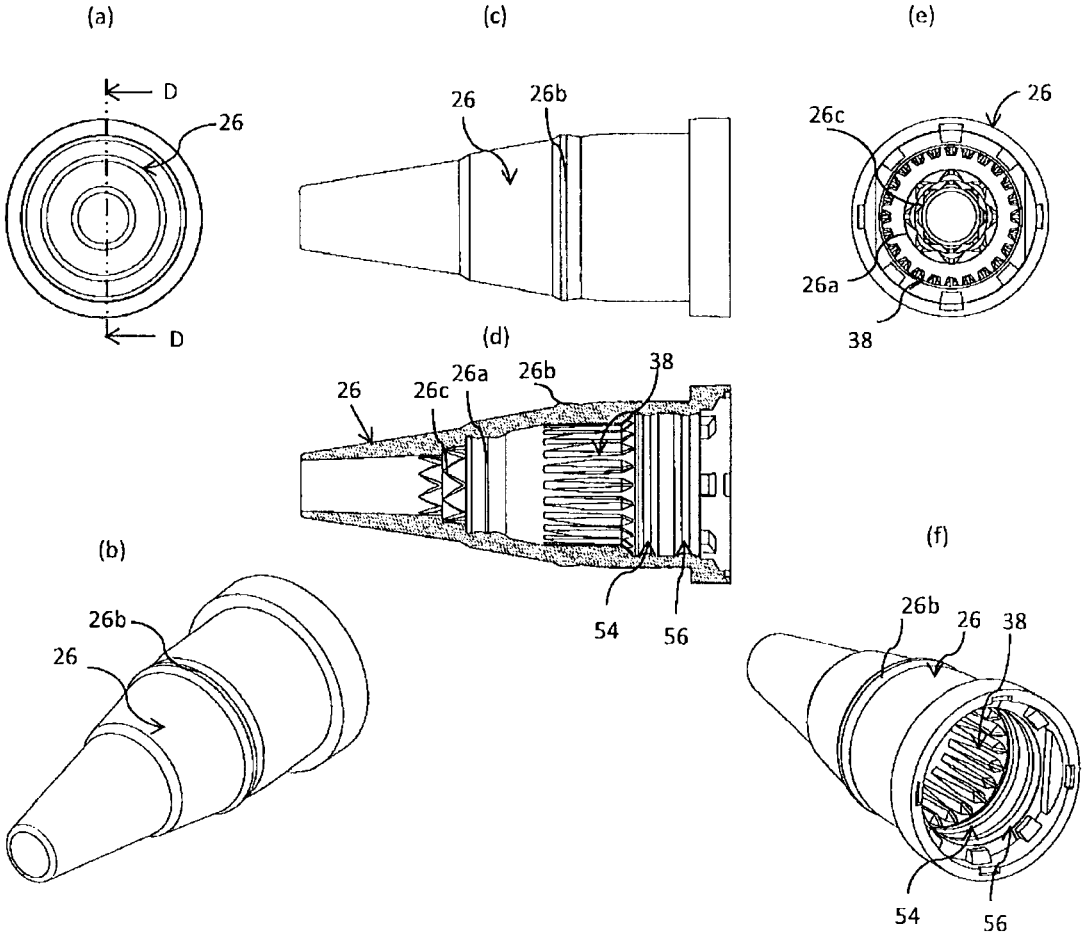
FIG. 4 Parts drawing of a front barrel as a constituent in the applicator of FIG. 1, (a) a front side, (b) a perspective view from the front, (c) a side section, (d) a vertical section of cut along a line D-D in (a), and (f) a perspective view from the rear.
Figure 10:
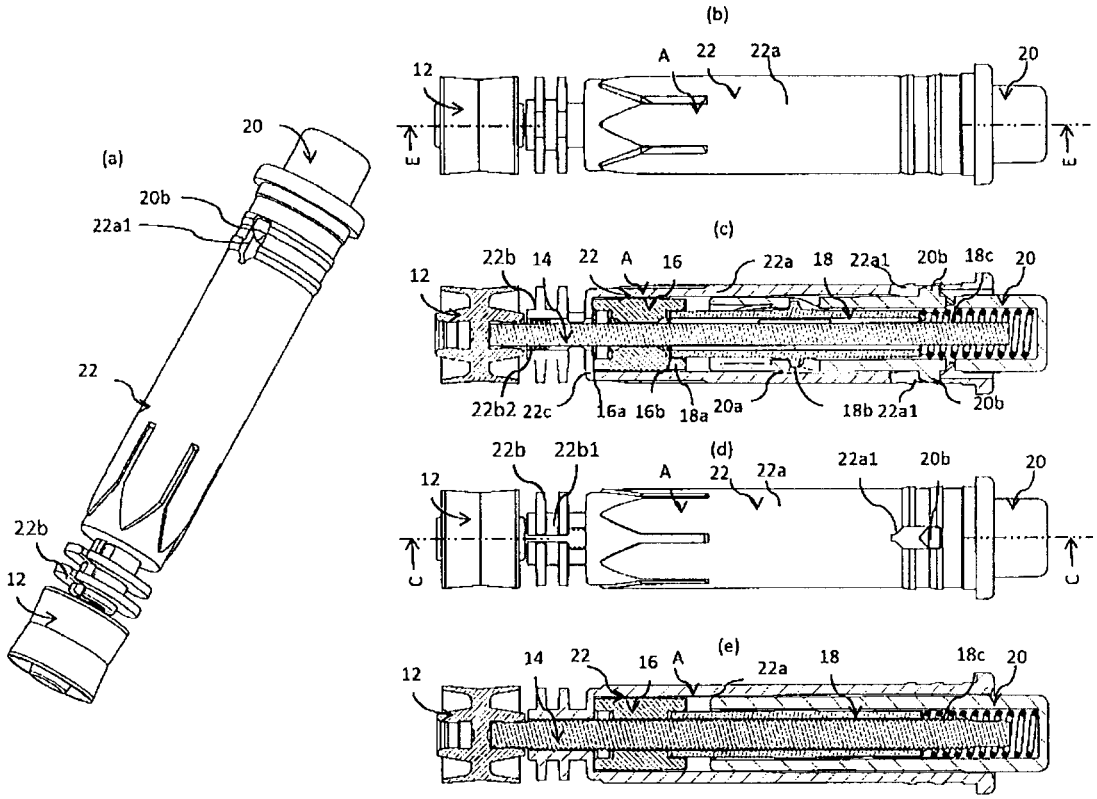
FIG. 10 Parts drawing of the applicator in FIG. 1, showing its non-pushed state of a propelling mechanism, (a) a perspective view, (b) a side view, (c) a vertical section cut along a line C-C in (d), (d) a side view of a state rotated 90 degrees from (b), and (e) a vertical section cut along a line E-E in (b).
Figure 11:
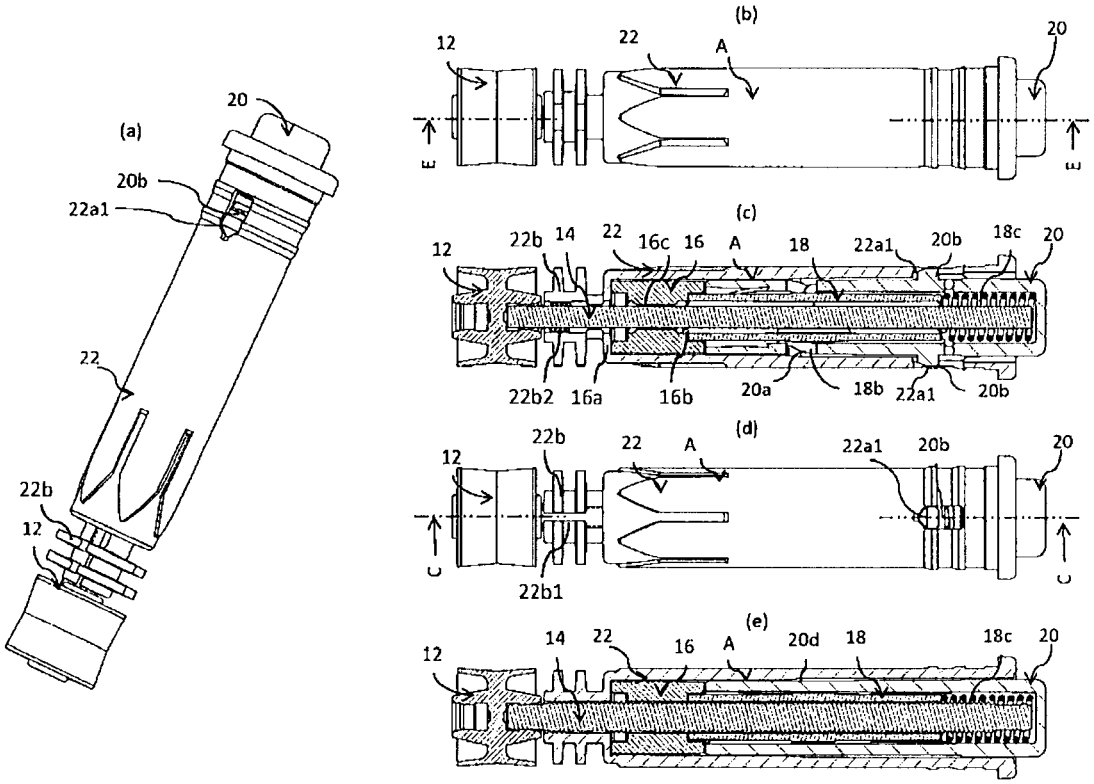
FIG. 11 Parts drawing of the propelling mechanism in FIG. 10, showing its pushed state, (a) a perspective view, (b) a side view, (c) a vertical section cut along a line C-C in (d), (d) a side view of a state rotated 90 degrees from (b), and (e) a vertical section cut along a line E-E in (b).
Figure 12:
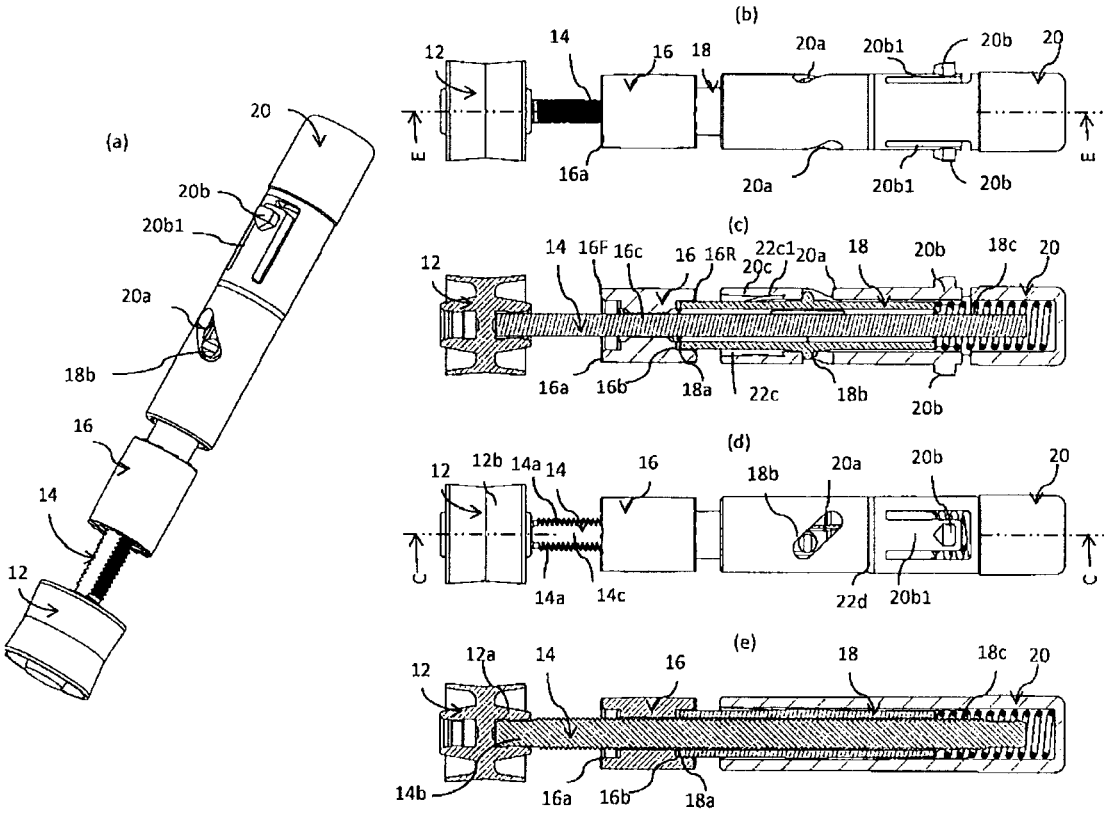
FIG. 12 Parts drawing of the propelling mechanism in FIG. 10, showing its state of a thread body removed, (a) a perspective view, (b) a side view, (c) a vertical section cut along a line C-C in (d), (d) a side view of a state rotated 90 degrees from (b), and (e) a vertical section cut along a line E-E in (b).
Figure 13:
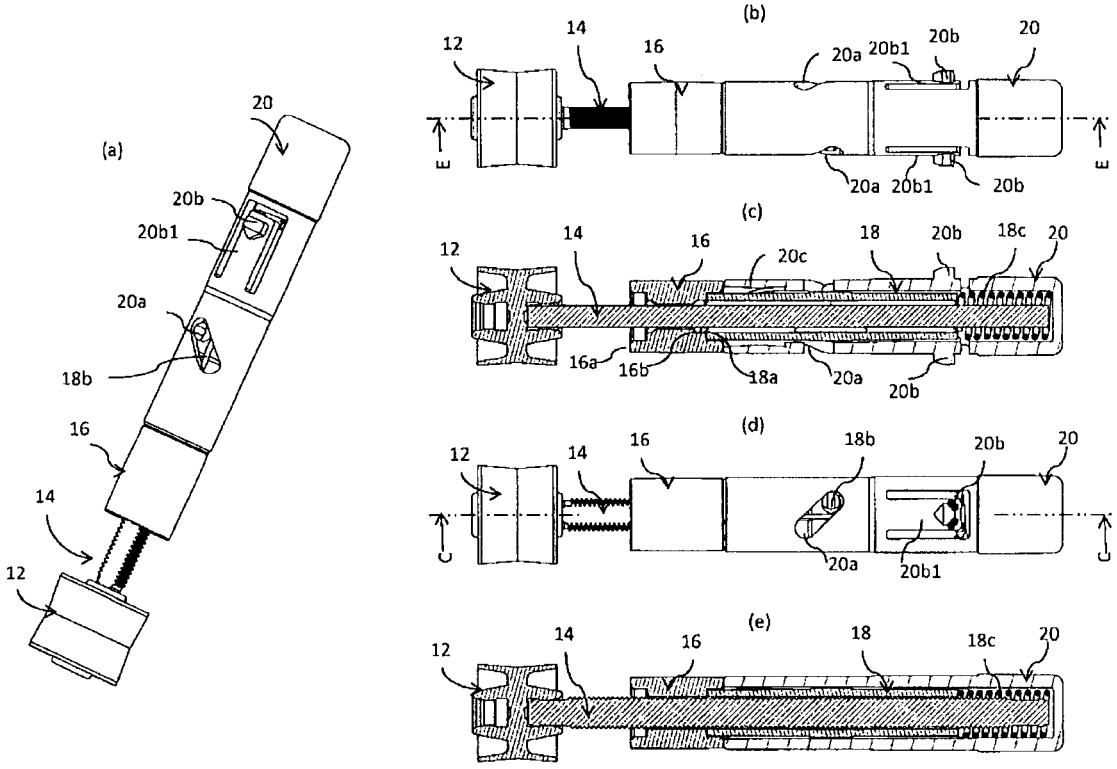
FIG. 13 Parts drawing of the propelling mechanism in FIG. 10, showing its pushed state (pressed state) with the screw body removed, (a) a perspective view, (b) a side view, (c) a vertical section cut along a line C-C in (d), (d) a side view of a state rotated 90 degrees from (b), and (e) a vertical section cut along a line E-E in (b).

FIGS. 10 and 11 are parts diagrams of the propelling mechanism A. FIG. 10 shows the non-pushed state, and FIG. 11 shows the pushed state. FIGS. 12 and 13 are parts diagrams when the screw body 22 is removed from the propelling mechanism A. FIG. 12 shows the non-pushed state, and FIG. 13 shows the pushed state. FIGS. 2, 3 and 4 are parts diagrams of a seal joint 36, the barrel cylinder 10, and the front barrel 26, respectively.

(Propelling Mechanism A)

As shown in FIGS. 10 and 11, the propelling mechanism A includes: the rotary cam body 16 which is restricted so as not to rotate relative to the screw shaft 14 and has cams 16*a* and 16*b* formed at the front and rear, respectively; the transmission cam body 18 which has a cam 18*a* in front thereof to mesh with the cam 16*b* in the rear of the rotary cam body 16 and a protrusion 18*b* formed on the side surface thereof; the propelling body 20 which has a guide slot 20*a* for guiding the protrusion 18*b* of the transmission cam body 18 and rotates the transmission cam body 18 via the guide slot 20*a* and the protrusion 18*b* as it moves forward and backward; a spring 18*c* which elastically urges the propelling body 20 backward and the transmission cam body 18 forward; and the screw body (corresponding to the "fixed cam body") 22, which has a cylindrical portion 22*a* in the rear thereof that incorporates the transmission cam body 18, the rotary cam body 16, the spring 18*c*, the screw shaft 14 and the propelling body 20 and is integrally formed therein with a rearward-facing cam 22*c*, and has the threaded portion 22*b* mating with the screw shaft 14 in the front thereof.

Other than the above configuration, the screw body 22, the rotary cam body 16 and the screw shaft 14 may be configured such that the treaded portion of the screw body 22 is formed in a variant hole that mates with the cross section of the screw shaft 14 so as to restrict relative rotation therebetween while a female threaded portion is formed on the inner circumference of the rotary cam body 16, so that the threaded portion mates with a male thread on the peripheral surface of the screw shaft 14, to thereby constituting a propelling mechanism.

Further, the guide slot 20*a* of the propelling body 20 is formed obliquely at an angle with respect to the axial direction (the front-rear direction of the applicator).

In the push-type applicator, when the propelling body 20 is advanced by a pushing operation on the propelling mechanism A, the advance motion is converted into a rotational motion of the transmission cam body 18 in one direction (clockwise with respect to the front of the axis in this embodiment), and the cam 18*a* of the transmission cam body 18 meshes the cam 16*b* in the rear of the rotary cam body 16 so that the rotation of the transmission cam body 18 turns the rotary cam body 16 and advances the screw shaft 14 and hence the piston 12. On the other hand, when the propelling body 20 is moved backward by the elastic force of the spring 18*c* as the pushing operation is released, the combination of the guide slots 20*a* and the protrusions 18*b* converts the backward motion into the rotational motion of the transmission cam body 18 in the other direction (counter-clockwise with respect to the front of the axis) so as to return to the original position while the cam 16*a* in front of the rotary cam body 16 meshes the cam 22*c* of the cylindrical portion 22*a* so that the rotational motion of the rotary cam body 16 is restricted, whereby the motions of the screw shaft 14 and the piston 12 are restricted.

(Application Body 24)

As shown in FIGS. 1, 5 to 9, in the applicator, the application body 24 is attached to a front end portion 10*a* of the barrel cylinder (rear barrel) 10 by means of the front barrel 26. The application body 24 is not particularly specified as long as it is a material which can soak up an application liquid and can apply it, such as a resin fiber bundle or a porous body. In the embodiment, the material is packed into a flange shape in the rear end by melting.

(Application Liquid) The application liquid stored in the storage portion 10*b* of the barrel cylinder 10 is a cosmetic liquid, ink for writing instruments, or a chemical solution. In particular, in the case of a cosmetic liquid having a high viscosity (preferably a viscosity of 300 mPa·s or higher), propelling of the liquid can be made easy.

In the embodiment, the oily cosmetic fluid can be stored in the storage portion 10*b* and used. Suitable oily cosmetic fluid in this embodiment contains at least (a) 5 to 40% by weight of hydro fluoro ether, (b) 20 to 60% by weight of low boiling point silicone oil, (c) 2 to 10% by weight of silicone resin, (d) 2 to 10% by weight of one or more thickeners selected from a group of crosslinked methylpolysiloxane, inulin stearate, and sucrose fatty acid ester, and (e) 10 to 40% by weight of powder, and volatile hydrocarbons, and has a viscosity of 300 mPa·s to 400 mPa·s at 25° C. and a shear rate of 191.5/s.

When the oily cosmetic fluid is stored in the storage portion 10*b*, it is preferable to use polybutylene terephthalate resin (PBT resin) as the material of the barrel cylinder 10.

(Whole Applicator)

In the applicator, as shown in FIG. 5, the front end portion 10*a* of the barrel cylinder (rear barrel) 10 is formed to be smaller in diameter in a stepped manner than the portion of the storage portion 10*b* in the barrel cylinder 10. The cap 28 is detachably fitted to the front end portion 10*a* of the barrel cylinder 10 so as to cover the front barrel 26 and the application body 24. A pipe joint 30 is located inside the portion of the front barrel 26 that is fitted into the front end portion 10*a* of the barrel cylinder 10 so as to hold the flange at the rear end of the application body 24 between the front end of the pipe joint 30 and the inner surface of the front barrel 26 and thereby fix the application body 24. A pipe 32 made of SUS or resin extends from the central hole of the pipe joint 30 into the application body 24 so that the application liquid can flow toward the tip of the application body 24 through the pipe 32.

On the outer circumferential side of a portion (stepped portion 10*c*) forming a step to the front end portion 10*a* of the barrel cylinder 10, the front barrel 26 abuts against the forward-facing surface of the step at the time of full coupling (see FIG. 6). Further, the inner circumferential surface side of the stepped portion 10*c* faces rearward and is exposed to the storage portion 10*b* of the application liquid. When the piston reaches the full-forward position, the piston 12 abuts or is positioned close to the rearward-facing surface so that its position is regulated (see FIG. 9).

The barrel cylinder 10 is constructed such that the storage portion 10*b* for the application liquid is arranged inside the front part thereof while the propelling mechanism A including the screw body 22, the screw shaft 14, the rotary cam body 16, the transmission cam body 18, the spring 18*c* and the propelling body 20 is arranged inside the rear part thereof so as to provide the function of feeding the application liquid to the application body 24 by advancing the piston 12 inside the storage portion 10*b* (see FIGS. 1, 5 to 9). The barrel cylinder 10 has the application liquid and a stirring piece 10*d* for stirring the application liquid inside the storage portion 10*b*. The stirring piece 10*d* may be a metal or resin ball or a rod-shaped piece.

In the applicator, as shown in FIG. 5, the stopper ring 34 that keeps the front barrel 26 virgin when not in use is interposed between the front endface of the stepped portion 10*c* of the barrel cylinder 10 and the rear endface of the front barrel 26. The tubular seal joint 36 is fitted in the front end portion 10*a* of the barrel cylinder 10. The seal joint 36 has the seal ball 36*a* fitted in a small-diametric portion 36*b* to seal the storage portion 10*b* when the applicator is virgin.

When the user starts using the product, the stopper ring 34 is removed from the virgin state of FIG. 5, as shown in FIG. 1, and the front barrel 26 is pressed backward against the front end portion 10*a* of the barrel cylinder 10, whereby the rear end portion of the pipe joint 30 is pressed into the seal joint 36 from the temporary coupled state of FIG. 7 to the fully coupled state of FIG. 6, so as to push out the seal ball 36*a* into the storage portion 10*b* and let the storage portion 10*b* open. As the propelling mechanism A is operated, the piston 12 advances and supplies the application liquid to the application body 24 through the seal joint 36, the pipe joint 30 and the pipe 32.

As shown in FIG. 5, the cap 28 has an inner cap 28*a* and an urging spring 28*b* arranged therein. The applicator is constructed such that the inner cap 28*a* urged by the spring 28*b* comes into airtight contact with the peripheral surface of the front barrel 26 before it starts to be used or when it is not used. Therefore, the application body 24 is prevented from drying.

(Propelling Mechanism A)

Next, the configuration of parts in the propelling mechanism A will be described.

Figure 14:
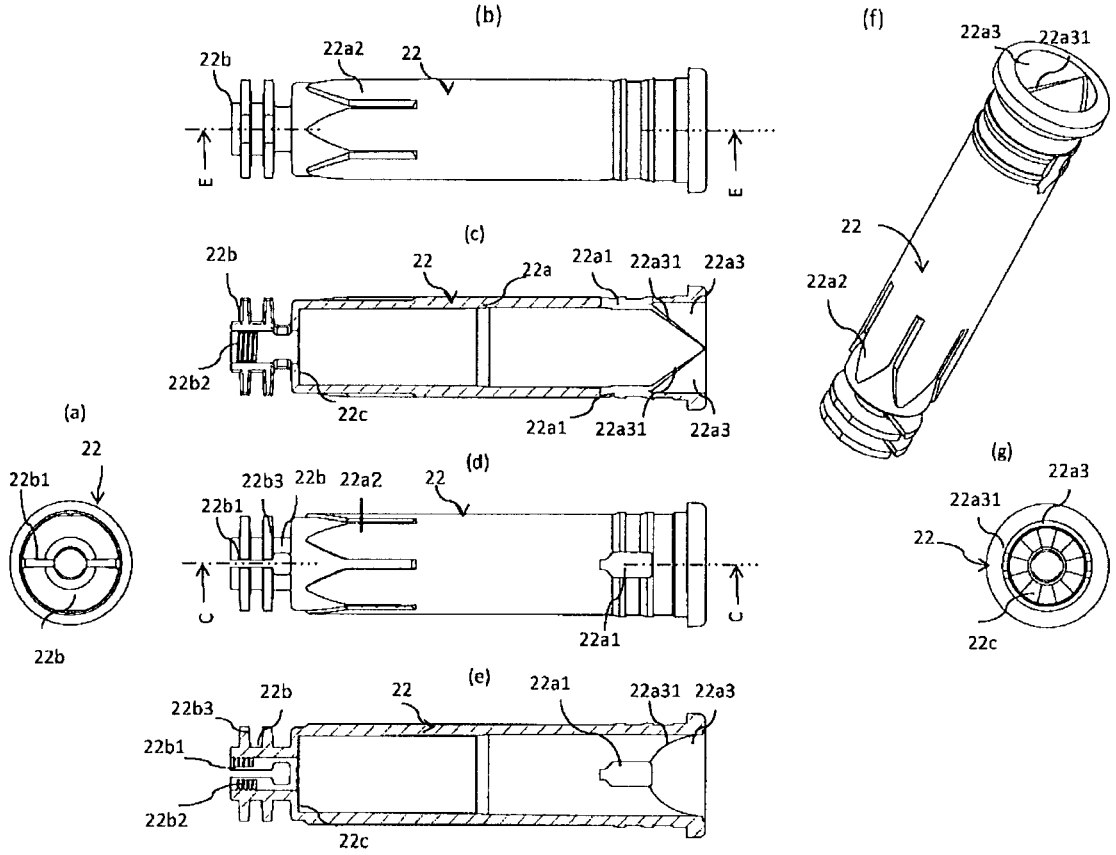
FIG. 14 Parts drawing of the screw body of the applicator in FIG. 1, (a) a view seen from the front, (b) a side view, (c) a vertical section cut along a line C-C in (d), (d) a side view of a state rotated 90 degrees from (b), (e) a vertical section cut along a line E-E in (b), (f) a perspective view from the rear, and (g) a view seen from the rear.
Figure 15:
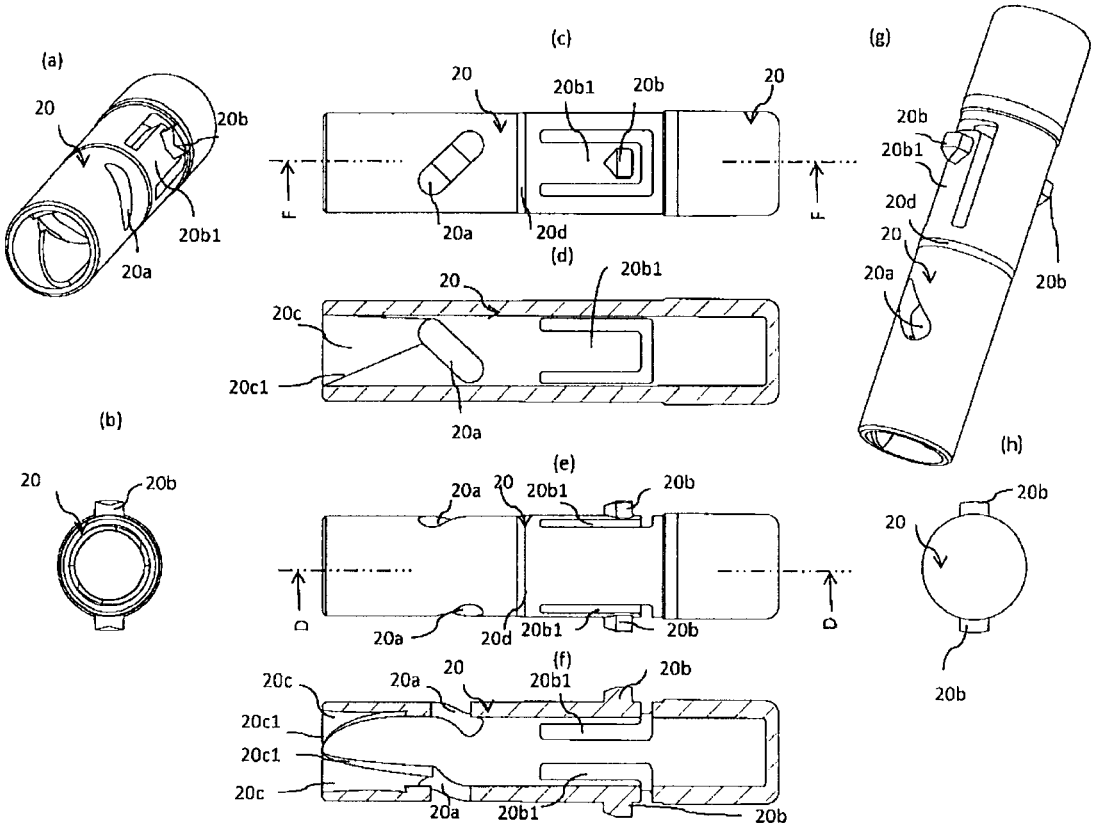
FIG. 15 Parts drawing of the propelling mechanism of the applicator in FIG. 1, (a) a perspective view, (b) a view seen from the front, (c) a side view, (d) a vertical section cut along a line D-D in (e), (e) a side view of a state rotated 90 degrees from (c), (f) a vertical section cut along a line F-F in (c), (g) a perspective view, and (h) a view seen from the rear.
Figure 16:
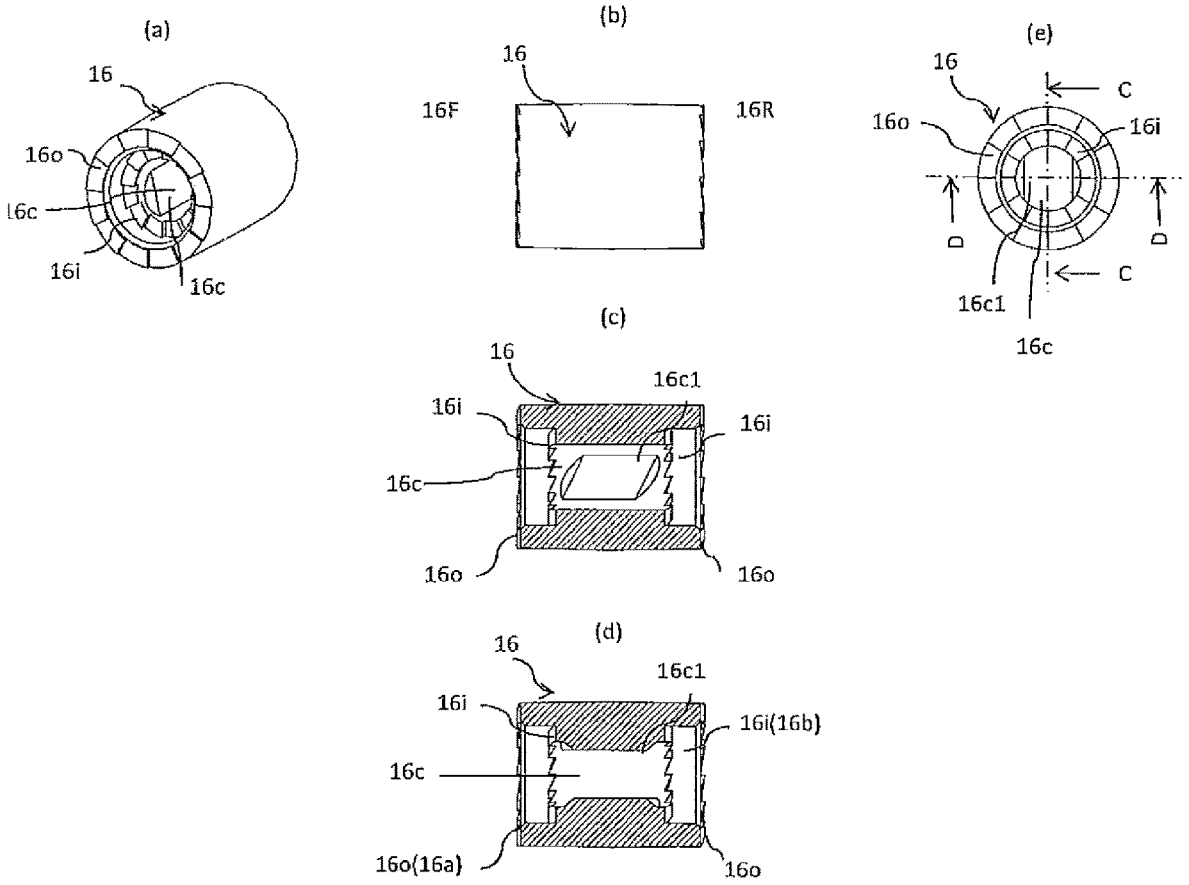
FIG. 16 Parts drawing of a rotary cam body of the applicator in FIG. 1, (a) a perspective view, (b) a side view, (c) a vertical section cut along a line C-C in (e), (d) a vertical section cut along a line D-D in (e), and (e) a view from one direction.
Figure 17:
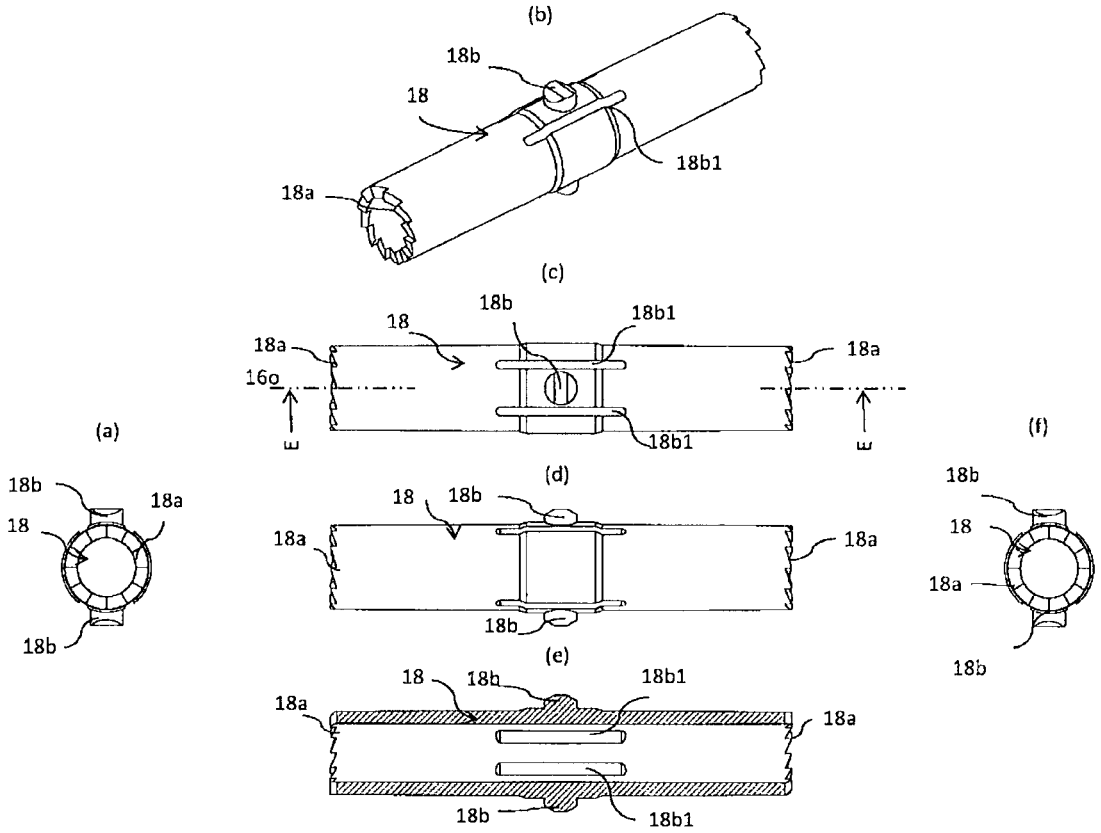
FIG. 17 Parts drawing of a transmission cam body in the applicator in FIG. 1, (a) a view seen from one direction, (b) a perspective view, (c) a side view, (d) a side view of a state rotated 90 degrees from (c), (e) a vertical section cut along a line E-E in (c), and (f) a view from another direction.
Figure 18:
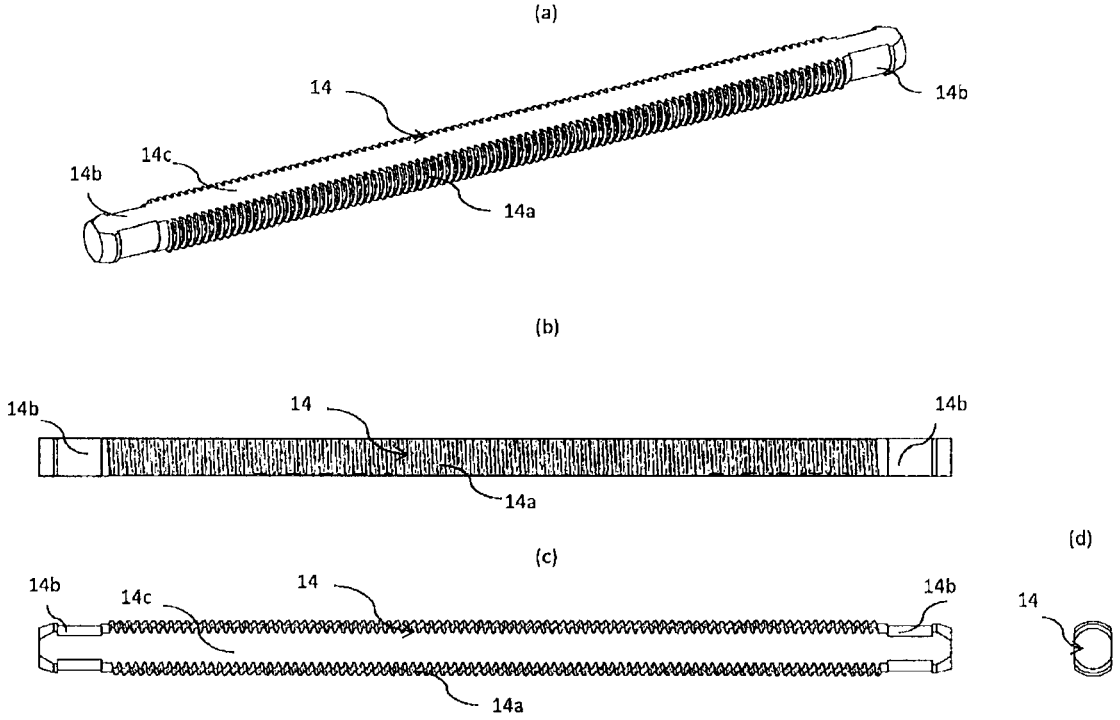
FIG. 18 Parts drawing of a screw shaft in the applicator in FIG. 1, (a) a perspective view, (b) a side view, (c) a side view of a state rotated 90 degrees from (b), and (d) a view from the rear.

As shown in FIGS. 10 to 11, the propelling mechanism A has the screw shaft 14, the propelling body 20, the rotary cam body 16, the transmission cam body 18 and the spring 18*c* installed in the screw body 22. FIGS. 12 and 13 show a state in which the screw body 22 is removed. Among the parts of the propelling mechanism A, FIG. 14 shows the screw body 22, FIG. 15 shows the propelling body 20, FIG. 16 shows the rotary cam body 16, FIG. 17 shows the transmission cam body 18, and FIG. 18 shows the screw shaft 14. Each part will be described below.

(Screw Body 22)

As shown in FIG. 14, the screw body 22 has a substantially cylindrical shape with its front and rear open with a threaded portion (corresponding to the "female threaded portion") 22*b* arranged in front, which becomes smaller stepwise in diameter than a cylindrical portion 22*a*.

A cam 22*c* is formed on the inner surface at the front end of the cylindrical portion 22*a*.

The threaded portion 22*b* extends substantially in a cylindrical shape from the front end of the cylindrical portion 22*a*, but is bifurcated by a tip split 22*b*1 cut in the axial direction, so as to be possibly deformed radially in an elastic manner. Multiple threads (e.g., one to three threads) are inwardly projected and formed on the inner circumference of the threaded portion 22*b*, forming a female thread 22*b*2 mating with the screw shaft 14. Further, flange-like vanes 22*b*3 abutting the inner circumferential surface of the barrel cylinder 10 are formed on the outer circumferential portion of the threaded portion 22*b*.

Formed on the peripheral side of the cylindrical portion 22*a* are multiple projected ribs 22*a*2 so as to extend in the axial direction in order to stop rotation relative to the inner surface of the barrel cylinder 10. Windows 22*a*1 are formed behind the ribs 22*a*2.

The ribs 22*a*2 are configured to be engaged with longitudinal ribs 10*f* (see FIG. 3) on the inner surface of the barrel cylinder 10, so as to stop the screw body 22 from rotating, whereby preventing rotation failure at the time of pushing.

As shown in FIG. 14, a thin-walled portion 22*a*3 having an inclined surface whose diameter increases from the rear to the front is formed on the inner surface of the cylindrical portion 22*a*. For more information, on the inner surface of the cylindrical portion 22*a*, the thin-walled portion 22*a*3 is formed such that two semicircular-shaped portions are cut out from the rear end surface of the cylindrical portion 22*a* toward the window 22*a*1. The thin-walled portion 22*a*3 is contiguous to the other portion of the cylindrical portion 22*a* with a semicircular step 22*a*31 therebetween.

The step 22*a*31 enclosing the thin-walled portion 22*a*3 is formed in a semicircular or triangular shape, extending from the rear end of the cylindrical portion 22*a* to the window 22*a*1 (see FIGS. 14 (*c*) and 14 (*e*)). The shape of the thin-walled portion 22*a*3 is not limited to this.

Since the thin-walled portion 22*a*3 is formed, when the assembly of the piston 12, the screw shaft 14, the rotary cam body 16, the transmission cam body 18, the spring 18*c*, and the propelling body 20 (see FIGS. 12 and 13) are inserted into the cylindrical portion 22*a* of the screw body 22, the propelling body 20 is pushed in. At that time, the propelling body 20 is guided, rotated and positioned as the protrusions 20*b* abut on the steps 22*a*31 (see FIG. 14) of the thin-walled portion 22*a*3, slide toward the windows 22*a*1 and into the windows 22*a*1.

Therefore, when the propelling body 20 is inserted into the cylindrical portion 22*a*, the protrusions 20*b* can be fitted into the windows 22*a*1 by simply inserting the propelling body 20 into the cylindrical portion 22*a* without having to align the protrusions 20*b* to the windows 22*a*1 in the circumferential direction. Thus, no positioning is needed so that the work efficiency gets improved.

Further, since the threaded portion 22*b* is bifurcated in the tip split 22*b*1, the threaded portion 22*b* can be elastically deformed so that the screw shaft 14 is inserted by pushing it into the threaded portion 22*b* when assembling the screw shaft 14. Therefore, the screw shaft 14 can be built in without having to turn the screw shaft 14 into the threaded portion 22*b* and it enables easy and reliable placement and significantly reduces the workload on the production line.

Further, the screw body 22 is formed with a cam 22*c* having multiple inclined facets facing rearward inside the cylindrical portion 22*a* behind the threaded portion 22*b*. The forward-facing cam 16*a* of the above-described rotary cam body 16 is arranged so as to oppose this rearward-facing cam 22*c* (see FIG. 10).

As shown in FIG. 14, since the rearward-facing cam 22*c* is integrally formed with the inclined facets inside the cylindrical portion 22*a* of the screw body 22, the number of parts can be reduced as compared with the case where the cam is provided separately. Further, the female thread 22*b*2 on the inner side of the threaded portion 22*b* becomes engaged with the screw shaft 14 when assembled. The vanes 22*b*3 on the peripheral side are partially formed to be thin wall and abut the contact portion with the inside of the barrel cylinder 10, whereby the vanes 22*b*3 prevent the screw body 22 from spreading due to shrinkage during molding. The vanes 22*b*3 are assembled so as to be in contact with the ribs 10*f* (see FIG. 3) on the inner surface of the barrel cylinder 10. The number of vanes 22*b*3 is preferably two from the viewpoint of satisfying the storage amount of the application liquid and preventing the spreading both.

Further, the formation of the tip split 22*b*1 improves the flexibility in designing the molding die, which can lead to cost reduction.

The window 22*a*1 of the cylindrical portion 22*a* is configured to engage with the protrusion 20*b* of the propelling body 20 so that the propelling body 20 will not rotate when the propelling body 20 is pressed. This prevents ejection defects (see FIGS. 10 and 11).

(Propelling Body 20)

As shown in FIG. 15, the propelling body 20 (pushing body) has a substantially cylindrical shape with a closed rear end, and a pair of guide slots 20*a* are formed obliquely with the axial direction in the front portion thereof and penetrate from the interior to the exterior of the peripheral wall.

The propelling body 20 is configured so that when the propelling body 20 is moved forwards as the user pushes the periphery of the closed rear endface thereof, the combination of the guide slots 20*a* and the protrusions 18*b* on the side surface of the transmission cam body 18 converts the advance motion into a rotational motion of the transmission cam body 18, whereby the rotational motion of the transmission cam body 18 causes the rotary cam body 16 to rotate so as to advance the screw shaft 14, hence the piston 12 (see FIGS. 10 and 11).

Further, as shown in FIG. 15, a U-shaped cutout is formed on the side portion in the rear part of the propelling body 20 to construct an elastically deformable, cantilevered arm portion 20*b*1 with a protrusion 20*b* on the outer side thereof. Further, the periphery of the middle side of the propelling body 20 is formed annularly so that the rear part behind the stepped portion 20*c*1 of the propelling body 20 is thicker in diameter than the front part. The large-diameter portion behind the stepped portion 20*c*1 is in contact with the inner circumferential surface of the cylindrical portion 22*a* of the screw body 22 so as keep the interface between the propelling body 20 and the cylindrical portion 22*a* airtight (see FIGS. 10 and 11).

Further formed on the inner circumferential surface of the front portion of the propelling body 20, as shown in FIG. 15, are guide portions 20*c* for guiding the protrusions 18*b* (see FIGS. 10 and 17) to the guide slots 20*a* when the transmission cam body 18 is assembled. Two guide portions 20*c* are formed corresponding to respective guide slots 20*a*, by thinning the inner circumference to be thin-walled from the front edge of the propelling body 20 toward the surrounding of the guide slots 20*a*. Stepped portion 20*c*1 are formed step-wise from the thin-walled guiding portion 20*c* to connect to the other thicker portion. Two guide portions 20*c* are formed. The width between the stepped portions 20*c*1 and 20*c*1 enclosing each the guide portion 20*c* spreads over approximately half of the front circumferential edge of the propelling body 20, becomes narrower toward the rear so as to correspond to the width (narrow or wide) of the guide slot 20*a* near the guide slot 20*a*. The width between the stepped portions 20*c*1 and 20*c*1 is formed in a substantially triangular slope or wedge shape (see FIG. 15 (*d*)). The adjacent guide portions 20*c* may overlap, or be spaced from, each other at the front edge (the respective stepped portions 20*c*1 may be spaced or may be formed from a position inward from the front edge).

In assembling, the transmission cam body 18 is fitted into the propelling body 20 from the front. In this case, since the transmission cam body 18 does not have any distinction between front and rear, no front and rear positioning is required, so that less workload is needed. When the transmission cam body 18 is inserted into the propelling body 20, the pair of projected protrusions 18*b* are attached against the stepped portions 20*c*1 and 20*c*1 (see FIG. 15) and guided to fit into the pair of guiding portions 20*c*. Then, as the transmission cam body 18 advances backwards, the protrusions 18*b* abut the stepped portions 20*c*1 and 20*c*1 and are guided by the guiding portions 20*c* to slide and fit into the guide slots 20*a*.

Thus, the protrusions 18*b* are guided to fit into the guide slots 20*a* simply by inserting the transmission cam body 18 into the propelling body 20, so that it is not necessary to position the protrusions 18*b* with respect to the guide slot 20*a* in the circumferential direction, hence no positioning is needed. Therefore, this reduces the working processes and provides extreme efficiency.

(Front-Rear Symmetrical Parts)

Among the constituents of the applicator, the rotary cam body 16 as shown in FIG. 16, the transmission cam body 18 as shown in FIG. 17 and the screw shaft 14 as shown in FIG. 18 are formed to be front-rear symmetrical. These parts will be described.

(Rotary Cam Body 16)

As shown in FIG. 16, the rotary cam body (feeding cam) 16 has a symmetrical shape between the front side, 16F and the rear side, 16R, and has a substantially cylindrical shape having a hollow.

An outer circumferential cam (16*o*) and an inner circumferential cam (16*i*) are formed on the front side 16F and the rear side 16R, respectively. The equivalent functions are obtained regardless of whether the front side 16F and the rear side 16R are oriented and mounted in the screw body 22.

In the rotary cam body 16, the outer circumferential side cam (16*o*) and the inner circumferential side cam (16*i*) respectively function as the front cam 16*a* and rear cam 16*b*, which are involved in the propelling mechanism A shown in FIG. 10.

As shown in FIG. 5, the rotary cam body 16 has the forward-facing and backward-facing cams 16*a* and 16*b* formed on both the front and the rear portions in the axial direction. The cam 18*a* formed at the front of the transmission cam body 18 is disposed so as to oppose the rearward-facing cam 16*b* of the rotary cam body 16.

Protrusions 16*c*1 for anti-rotation are formed on the inner circumferential surface of an internal through hole 16*c*. The protrusions 16*c*1 engage with flat cutouts 14*c* on the peripheral surface of the screw shaft 14 (see FIGS. 12 and 18), to thereby provide the function of enabling relative back-and-forth movement in the axial direction while restricting relative rotation between the rotary cam body 16 and the screw shaft 14.

(Transmission Cam Body 18)

As shown in FIG. 17, the transmission cam body 18 alone has a large diameter in the middle portion, and front and rear portions slightly smaller in diameter than the middle portion, and extended cylindrically forward and backward, and has front and rear endface cams, each forming the cam (18*a*). A pair of protrusions 18*b* are projected from the opposite peripheral side in the middle portion. A pair of cutouts 18*b*1 and 18*b*1 that penetrate through from the interior to the exterior of the peripheral wall are formed in the middle portion so as to sandwich the area where each protrusion 18*b* is formed. In the middle portion, the area around the protrusion 18*b* sandwiched by the cutouts 18*b*1 and 18*b*1 is formed so as to be elastically deformable.

In the coupled state, as shown in FIG. 12, the front portion of the transmission cam body 18 is slightly smaller in diameter than the middle portion and is inserted into the cylindrical rear portion of the rotary cam body 16 so that the cam 18*a* in the front of the transmission cam body 18 opposes the cam 16*b* of the rotary cam body 16.

The cam 18*a* of the transmission cam body 18 and the rearward-facing cam 16*b* of the rotary cam body 16 are each formed with saw teeth so that in their abutted state, the two cams engage with other when the transmission cam body 18 rotates in a first direction whereas, conversely, the two cams easily disengage from each other when the transmission cam body 18 rotates in the second direction.

Specifically, as shown in FIG. 17, the cam 18*a* of the transmission cam body 18 is formed with a plurality of saw teeth, each having a triangular crest with its slope inclined in one side (e.g., clockwise direction) while, as shown in FIG. 16, the rearward-facing cam 16*b* of the rotary cam body 16 is formed with a plurality of saw teeth, each having a triangular crest with its slope inclined in the other direction (e.g., counterclockwise direction).

The forward-facing cam 16*a* of the rotary cam body 16 and the rearward-facing cam 22*c* inside the cylindrical portion 22*a* of the screw body 22 are each formed with saw teeth so that in their abutted state, the two cams engage with other when the rotary cam body 16 rotates in the second direction, whereas, conversely, the two cams easily disengage from each other when the rotary cam body 16 rotates in the first direction. Specifically, the forward-facing cam 16*a* of the rotary cam body 16 is formed with a plurality of saw teeth, each having a triangular crest with its slope inclined in one side (e.g., clockwise direction) while the rearward-facing cam 22*c* inside the cylindrical portion 22*a* of the screw body 22 is formed with a plurality of saw teeth, each having a triangular crest with its slope inclined in the other direction (e.g., counterclockwise direction).

The propelling body 20 arranged in the cylindrical portion 22*a* of the screw body 22 has a structure that can move within a certain range in the axial direction with its rotation relative to the screw body 22 restricted.

This structure that enables axial movement while restricting relative rotation is achieved by, specifically, as shown in FIG. 15, providing the protrusions 20*b* formed on the outer side of the elastically deformable cantilever-shaped arms on the side of the propelling body 20 and placing the protrusions 20*b* in the windows 22*a*1 that is long in the axial direction of the cylindrical portion 22*a*, so as to be movable back and forth (see FIGS. 10 and 11). Further, the protrusions 18*b* of the transmission cam body 18 are arranged to fit into the guide slots 20*a* while the spring 18*c* is interposed between the propelling body 20 and the transmission cam body 18 to repel each other. The spring 18*c* is preferably a coil spring made of metal, resin or the like.

It should be noted that in the coupled state, the cam formed on the outer circumference at the rear end of the rotary cam body 16 and the cam formed at the rear end of the transmission cam body 18 are not involved in the cam operation.

(Screw Shaft 14)

As shown in FIGS. 12 and 18, the screw shaft 14 has male threaded portions 14*a* and 14*a* formed in arcuate areas paired diametrically on the outer circumferential surface of the screw shaft 14 with flat cutouts 14*c* and 14*c* formed between the threaded portions 14*a* and 14*a*. Further, the screw shaft 14 is front-rear symmetrical with respect to the axial direction while fitting portions 14*b* that fit into a main body 12*a* of the piston 12 so as to allow for rotation and prevent it from coming off are formed at both the front and rear ends of the screw shaft 14. The fitting portion 14*b* has a flange-like rib formed on the outer circumferential surface of the cylindrical portion extending to the front and the rear of the screw shaft 14.

When the screw shaft 14 is assembled in the rotary cam body 16, the front end or the rear end of the screw shaft 14 is inserted in the axial direction into the internal through hole 16*c* in the rotary cam body 16, as shown in FIG. 12. In assembling, the flat cutouts 14*c* of the screw shaft 14 engage with the protrusions 16*c*1 of the rotary cam body 16 as it is inserted. Since the screw shaft 14 is symmetrical in the front-rear direction, it is not necessary to consider the front-rear position at the time of insertion, so that no positioning as to the front-rear direction is needed, and the work is simplified.

(Piston 12)

As shown in FIG. 12 and others, the piston 12 is symmetrical in the front-rear direction and axisymmetric. The piston 12 is formed of the main body 12*a* having a hole into which the fitting portion 14*b* of the screw shaft 14 is fitted, and a sealing portion 12*b*, the diameter of which, becomes greater toward the front and the rear so as to surround the main body 12*a*. The hole of the main body 12*a* has an indented and projected portion formed so as to engage with the fitting portion 14*b* to allow rotation while restricting its back-and-forth movement. Further, the seal portion 12*b* is in sliding contact with the inner surface of the barrel cylinder 10 to keep the storage portion 10*b* liquid-tight.

(Seal Joint 36)

As shown in FIGS. 2 and 6, the seal joint 36 alone has the small-diametric portion 36*b* therein for receiving the seal ball 36*a* (see FIG. 1) and a projected portion 36*c* extended backward for preventing the stirring piece 10*d* and the seal ball 36*a* from clogging the seal joint 36. A flange 36*d* having an enlarged diameter is formed at the front end. The flange 36*d* abuts the endface of a front end portion 10*a* of the barrel cylinder 10 so as to be prevented from slipping into the front end portion 10*a* (see FIG. 1).

Next, the propelling operation (pushing operation) of the applicator of the above-described embodiment will be described with reference to FIGS. 6, 8, and 17 to 18.

Figure 19:
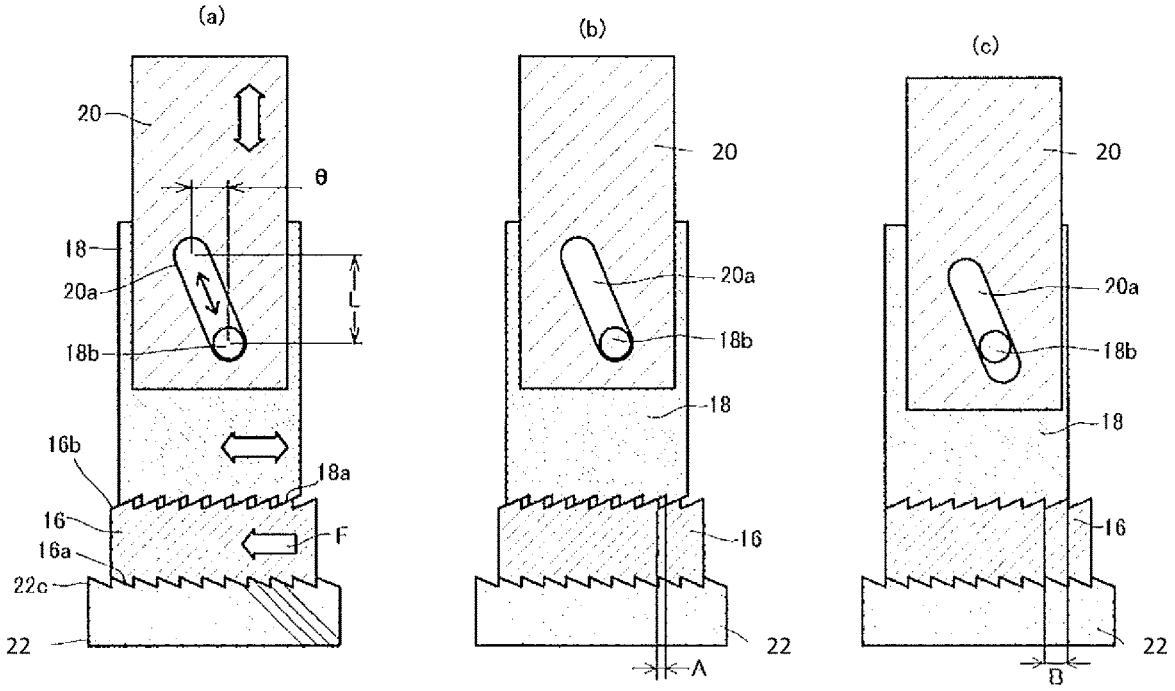
FIG. 19 Illustrative drawing of operation of the cam operation in the applicator in FIG. 1, with schematic diagrams of the screw body, rotary cam body, transmission cam body, and propelling body, (a) an illustrative diagram of the components, (b) an illustrative diagram of the initial state, and (c) an illustrative diagram of a state at the start of pushing.
Figure 20:
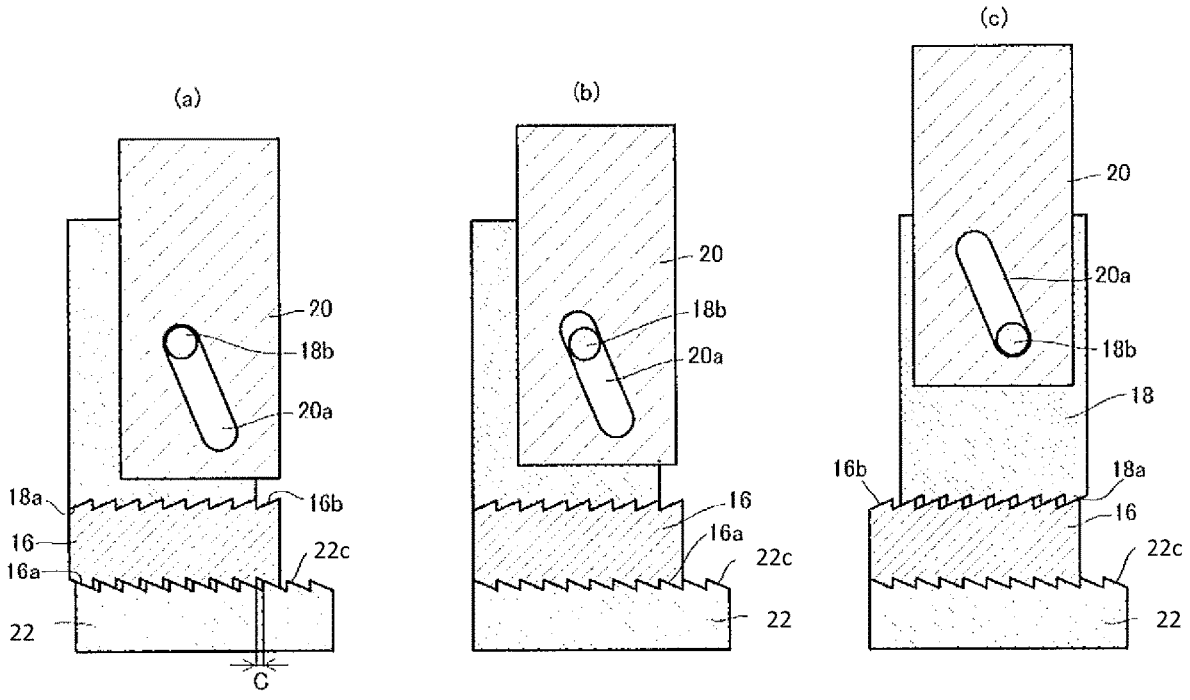
FIG. 20 Illustrative drawing of operation schematic diagrams as with FIG. 19, (a) a state diagram when fully pushed, (b) a state diagram when the push is released and stars to return, and (c) a state diagram of the initial state after the push is fully returned.

FIG. 6 shows the non-pushed state (original position) of the applicator, and FIG. 8 shows the pushed state. FIGS. 10 and 11 show the propelling mechanism A when it is not pushed and when it is pushed, respectively. FIGS. 19 to 20 are illustrative drawings of operation schematically showing the screw body 22, the rotary cam body 16, the transmission cam body 18, and the propelling body 20 in the propelling mechanism. In FIG. 19, (a) is an illustrative diagram of the components, (b) an illustrative diagram of the initial state, and (c) an illustrative diagram of a state at the start of pushing. In FIG. 20, (a) is a state diagram when fully pushed, (b) a state diagram when the push is released and stars to return, and (c) a state diagram of the initial state when the push is fully returned.

In the push-type applicator, the propelling body 20 is advanced as shown in FIG. 8 by a user pushing the outer periphery of the rear endface of the propelling body 20.

As shown in FIG. 19(*a*), the advance motion is converted into a rotational motion (a first direction: indicated by a reference numeral F) of the transmission cam body 18 by the guide slots 20*a* and the protrusions 18*b* on the side surface of the transmission cam body 18 at the time of the propelling operation. The rotation angle of the transmission cam body 18 is indicated by el in the figure, and the push stroke of the propelling body 20 is indicated by a symbol L.

The rotation of the transmission cam body 18 causes the rotary cam body 16 to rotate in the first direction to advance the screw shaft 14, hence the piston 12 (see FIG. 8). On the other hand, when the pressing is released, the propelling body 20 returns to the rear, and the transmission cam body 18 rotates in the second direction and returns to the original position.

For more information, as shown in FIGS. 19(*b*), 19(*c*) to 20(*a*), first, when the propelling body 20 is pressed forward, the propelling body 20 moves forward against the elastic force of the spring 18*c* (see FIG. 8). As a result, the protrusion 18*b* slides along the guide slot 20*a*, and the transmission cam body 18 rotates in the first direction (in the direction of arrow F). As shown in FIGS. 19(*b*) and 19(*c*), the rotation of the transmission cam body 18 in the first direction causes the rotary cam body 16 to start rotating in the first direction (in the direction of arrow F) by engagement between the cam 18*a* teeth of the transmission cam body 18 and the cam 16*b* teeth of the rotary cam body 16 that abut each other.

After FIG. 19(*c*), when the protrusion 18*b* slides backward along the guide slot 20*a* until the propelling body 20 reaches the bottom dead point and the rotary cam body 16 rotates, the teeth of the forward-facing cam 16*a* of the rotary cam body 16 climb over the teeth of the rearward-facing cam 22*c* inside the cylindrical portion 22*a* by the advancement of one pitch or more, and fit into the teeth of the next pitch when reaching the bottom dead point, as shown in FIG. 20(*a*).

By the actions shown in FIGS. 19(*b*), 19(*c*) and 20(*a*), the pushing operation of the propelling body 20 is transmitted from the rotation of the transmission cam body 18 to the rotation of the rotary cam body 16, and the rotation of the rotary cam body 16 turns the screw shaft 14 (not shown) so that the screw shaft 14 advances by the action of the female thread (female screw thread) 22*b*2 of the threaded portion 22*b*. This advance of the screw shaft 14 moves the piston 12 forward inside the storage portion 10*b* and feeds the application liquid toward the application body 24.

On the other hand, when the pressing operation of the propelling body 20 is released, as shown in the sequential order in FIGS. 20(*a*) to 20(*c*) the propelling body 20 moves backward thanks to the repulsive force of the spring 18*c*, so that the protrusions 18*b* slide forward along the guide slots 20*a*, and the transmission cam body 18 rotates in the other direction (in the opposite direction of F). The teeth of the forward-facing cam 16*a* of the rotary cam body 16 and the teeth of the rearward-facing cam 22*c* inside the cylindrical portion 22*a* of the screw body 22 mesh with each other to restrict the rotation of the rotary cam body 16, so that the transmission cam body 18 alone rotates in the second direction (see FIGS. 20(*b*) to 20(*c*)).

Then, the cam 18*a* teeth of the transmission cam body 18 and the cam 16*b* teeth of the rotary cam body 16 that abut each other become disengaged, and the cam teeth of the transmission cam body 18 advance and climb over one pitch or more, and fit into the teeth of the next pitch in the rotary cam body 16 without transmitting the rotational motion of the cam teeth of the transmission cam body 18 in the second direction to the rotary cam body 16. In that case, the cam geometry assumes the initial state with one pitch back, as shown in FIG. 20(*c*).

As an example of the pushing mechanism, the push stroke is set to be 2 mm.

As the user pushes to perform a propelling operation, the propelling body 20 advances by 1 mm with a pushing of 1 mm, so that the protrusion 18*b* of the transmission cam body 18 moves (rotates) along the guide slot 20*a* obliquely opened in the propelling body 20. When the push reaches 2 mm, the pushing is limited and the protrusion 18*b* of the transmission cam body 18 is fully rotated. During this process, the rotary cam body 16 rotates.

When the pushing operation is released, the propelling body moves back to the rear and the protrusion 18*b* of the transmission cam body 18 rotates in reverse along the guide slot 20*a*, whereas meshing between the cam of the transmission cam body 18 and the cam of the rotary cam body is disengaged so that the transmission cam body 18 rotates alone in the opposite direction with the rotary cam body 16 unrotated.

The conditions for an angle, θ, of the above rotation will be discussed.

When pushing the propelling body 20 by the push stroke L, the transmission cam body 18 rotates a rotation angle of θ degrees. When the rotation angle of one tooth of the transmission cam body 18 and the rotary cam body 16 (rear cam 16*b*) is specified as B, the relationship "θ>B" is required.

That is, if the rotation angle θ is not greater than the rotation angle B of one tooth, the crest of the cam cannot be climbed over.

Further, the angle by which the forward-facing cam 16*a* of the rotary cam body 16 advances after climbing over the cam 22*c* of the screw body 22 when fully pushed is denoted by C. Similarly, the angle by which the rotary cam body 16 further advances after climbing over the transmission cam body 18 is denoted by A when the push is returned to the original position, θ=A+B+C holds. Therefore, "θ>B" can be guaranteed by appropriately setting A and C that are excess rotations.

When A and C are small (little), there will occur a case where the cams cannot climb over due to the tolerance or variation of parts, whereas when they are too large, the push stroke must be increased unnecessarily, which is inefficient.

Considering one embodiment, if the cam is divided equally by 12, B=360/12=30 degrees. If A and C are set to 7.05 degrees, the rotation angle by pushing becomes θ=30+7.05+7.05=44.1 degrees. That is, one pushing produces a rotation with an angle of 44.1 degrees.

According to the push-type applicator of the embodiment, the guide slots 20*a* of the propelling body 20 are formed obliquely at an angle with respect to the axial direction, so that when the propelling body 20 is advanced by a pushing operation, the advance motion is converted into rotational motion of the transmission cam body 18 in a first direction by means of the guide slots 20*a* and the protrusions 18*b*. The cam of the transmission cam body 18 meshes with the cam at the rear of the rotary cam body 16 so that the rotation of the cam body 18 causes the rotary cam body 16 to rotate, whereby the screw shaft 14 is advanced to move the piston 12 forward. On the other hand, when the pushing operation is released, the propelling body 20 is moved backward by the elastic force of the spring 18*c*, the backward motion is converted into rotational motion of the transmission cam body 18 in the second direction by means of the guide slots 20*a* and the protrusions 18*b*, and the transmission cam body returns to the original position, whereas the cam at the front of the rotary cam body 16 meshes with the cam of the cylindrical portion 22*a* so as to restrict the rotational motion of the rotary cam body 16, hence the motion of the screw shaft 14 and the piston 12. Accordingly, the force acted by the pushing operation of the propelling body 20 can be transmitted to the piston 12 and used as the pressing force without loss of force, thus making it possible to lighten the operational feeling while preventing loss of pushing force when a high viscosity content is supplied.

At the same time, since the cylindrical portion 22*a* integrally formed with the rearward-facing cam 22*c* is provided for the screw body 22, the cam not being separated makes it possible to reduce the number of parts and facilitate the manufacturing as compared with a configuration in which the cam is provided separately.

Further, when the propelling body 20 is pressed forward, the protrusions 18*b* slide along the guide slots 20*a* and the transmission cam body 18 rotates in the first direction, so that the opposing cams of the transmission cam body 18 and the cam of the rotary cam body 16 mesh with each other while the forward-facing cam of the rotary cam body 16 and the rearward-facing cam inside the cylindrical portion 22*a* become disengaged from each other, whereby the rotary cam body 16 is rotated. This rotation of the rotary cam body 16 causes the thread shaft 14 to rotate, and advances by the action of the female screw of the threaded portion 22*b*. Then, when the pressing operation of the propelling body 20 is released, the propelling body 20 moves backward thanks to the repulsive force of the spring 18*c*, and the protrusions 18*b* slide along the guide slots 20*a* and the transmission cam body 18 rotates in the second direction, whereby the abutting cams of the transmission cam body 18 and the rotary cam body 16 become disengaged while the forward-facing cam of the rotary cam body 16 and the rearward-facing cam inside the cylindrical portion 22*a* of the screw body 22 become engaged with each other so that the rotation of the transmission cam body 18 in the second direction is prevented from being transmitted to the rotary cam body 16. Thus, repetition of the above pressing operation of the propelling body 20 enables smooth propelling of the piston 12.

Further, when the rearward-facing cams of the transmission cam body 18 and the rotary cam body 16, the forward-facing cam of the rotary cam body 16 and the rearward-facing cam inside the cylindrical portion 22*a* of the screw body 22, are formed with the same tooth pitch while the teeth of the rearward-facing cam and the forward-facing cam of the rotary cam body 16 are formed to be out of phase, the cam teeth of the rotary cam body 16 are set in the cam teeth of the cylindrical portion 22*a* before the pushing operation of the propelling body 20, while the cam of the transmission cam body 18 is out of phase with the rearward teeth of the rotary cam body 16 when the propelling body 20 is pushed. Therefore, the transmission cam body 18 rotates with the advancement of the propelling body 20. Then, when the pushing of the propelling body 20 is released, the cams of the rotary cam body 16 and the cylindrical portion 22*a* are assuredly meshed with each other, whereby the return rotation of the rotary cam body 16 can be reliably prevented.

Additionally, a ring-shaped seal (elastic material such as rubber or elastomer) is annularly interposed between the peripheral of the propelling body 20 and the inner circumference of the cylindrical portion 22*a* of the screw body 22, the seal can ensure airtightness from the propelling body 20 to the rear, and can securely prevent the content from drying or deteriorating.

Now, FIG. 1 shows the ready-to-use state and the initial coupled state of the applicator according to the embodiment, FIG. 5 shows the virgin state of the applicator, FIG. 6 shows the fully coupled state of the front barrel into the barrel cylinder, and FIG. 7 shows the temporary coupled state.

In the applicator of the embodiment, as shown in FIGS. 1, 5 to 7, the front barrel 26 is provided on the front end portion 10*a* of the barrel cylinder 10 so as to enclose the surround of the application body 24. The front barrel 26 and the barrel cylinder 10 each has a full coupling portion (a rear rib 56 of the front barrel 26 and a full coupling portion 42 of the barrel cylinder 10) and a temporary coupling portion (a front rib 54 of the front barrel 26 and a temporary coupling portion 44 of the barrel cylinder 10). The barrel cylinder 10 and the front barrel 26 each has anti-rotation ribs (reference numeral 46 in FIG. 3 for the barrel cylinder 10 and reference numeral 38 in FIG. 4 for the front barrel 26). In the initial coupled state (see FIG. 7) in which the temporary coupling portions of the barrel cylinder 10 and the front barrel 26 are engaged with each other, the anti-rotation ribs are not engaged with each other, while in the fully coupled state (see FIG. 6) in which the full coupling portions are fitted to each other, the anti-rotation ribs are engaged with each other.

The fully coupled state and the temporary coupled state will be described with reference to the parts drawing of the barrel cylinder 10 of FIG. 3 and the parts drawing of the front barrel 26 of FIG. 4.

(Barrel Cylinder 10)

The barrel cylinder 10 will be described.

As shown in FIG. 3, the barrel cylinder 10 has a substantially cylindrical shape. The front end portion 10*a* of the barrel cylinder 10 is formed on the front side of the main body having the storage portion 10*b* and has a diameter smaller than that of the main body. As shown in FIG. 3(*c*), formed annularly on the peripheral side of the front end portion 10*a* are two spaced ribs (a full coupling element 42F on the front side and a full coupling element 42R on the rear side) as the full coupling portion 42.

In the full coupling portion 42, the rib of the full coupling element 42F on the applying part side, or on the front side, forms the temporary coupling portion 44 whose front side is stepped to be large in diameter. Specifically, in the front end portion 10*a* of the barrel cylinder 10, the outside diameter forward of the full coupling element 42F is formed to be smaller than the rear outside diameter so as to form a step angled at substantially upright. The step on the front side of the joint element 42F functions the stepped portion of the temporary coupling portion 44.

Formed on the peripheral surface of the front end portion 10*a* of the barrel cylinder 10 is an anti-rattling portion 50 that radially supports the front barrel from the inside when in the temporary coupled state. Specifically, the anti-rattling portion 50 having the ribs that keep the temporary coupled state is formed along the axial direction between the full coupling element 42F on the front side and the full coupling element 42R on the rear side.

Further, the outside diameters of the front fitting element 42F and the rear fitting element 42R are different. In front of the temporary coupling portion 44, anti-rotation ribs 46 are formed to prevent the front barrel 26 from rotating relative to the barrel cylinder 10.

As shown in FIG. 3, the diameter of the front end portion 10*a* of the barrel cylinder 10 is reduced, whereas a concave-convex stepped fitting portion 10*e* is formed on the inner circumferential surface of the rear end portion. Further, longitudinal rib 10*f* are formed so as to project inward and extend in the axial direction, around the middle portion somewhat to the rear.

When the screw body 22 (see FIG. 1) is attached to the barrel cylinder 10, the screw body 22 is inserted forward from the open rear end of the barrel cylinder 10, and is fitted to the longitudinal ribs 10*f* on the periphery of the screw body 22 while moved forward.

The screw body 22 to which the cylindrical propelling body 20 with a closed rear end is attached so as to be unrotatable thereto, is fitted into the fitting portion 10*e* with the rear end of the propelling body 20 exposed from the rear end of the barrel cylinder 10 (see FIG. 1).

(Front Barrel 26)

FIG. 4 is parts drawing of the front barrel 26.

As shown in FIGS. 1 and 4, the front barrel 26 has a substantially cone shape in which the front side is thinner than the rear side. On the inner circumferential surface of the front barrel 26, a stepped rear endface of the front rib 54, which is a temporary coupling portion for temporary coupling with the temporary coupling portion 44 of the front end portion 10*a* of the barrel cylinder 10, and the front rib 54 and the rear rib 56 that are fully coupled with the full coupling portion 42 (42F, 42R) of the front end portion 10*a*, are formed over substantially the entire circumference. Formation of the front rib 54 and the rear rib 56 over substantially the entire circumference makes it possible to improve the temporary pulling force between the front barrel 26 and the barrel cylinder 10 in the initial coupled state, hence prevent the front barrel 26 from falling off the barrel cylinder 10 during transportation or the like.

The front rib 54 and the rear rib 56 have a substantially trapezoidal sectional shape taken on the plane along the axial direction. The sectional shapes of the ribs 54 and 56 are not limited to trapezoidal shapes having angled corners, but may have beveled or arc-shaped corners.

In the front barrel 26, the inner circumference of the front portion is formed in a cylindrical inner circumferential shape for accommodating the application body 24, and an engagement step 26*a* for fitting the pipe joint 30 is formed on the inner circumference in the middle portion. Further, an annular concavo-convex portion 26*b* for fitting and fixing the cap 28 is formed on the outer circumferential surface of the front barrel 26.

The front side of the front barrel 26 with respect to the engagement step 26*a* is the inner circumference of the rear portion, and multiple anti-rotation ribs 38 of longitudinal grooves for preventing rotation are formed on the inner side of the concavo-convex portion 26*b*.

On the inner circumference of the front barrel 26, a stepped engaging portion 26*c* against which the flange 24*a* of the application body 24 abuts is formed in front of the engagement step 26*a*. The engaging portion 26*c* is formed with triangular grooves in the front and rear of the step. Since the grooves guide the hair of the brush neck when the application body 24 is attached, it is possible to prevent the hair of the brush neck from turning back (reversing).

When the applicator of the embodiment is started to be used from the virgin state shown in FIG. 5, the applicator takes the initial coupled state shown in FIG. 1, the fully coupled state shown in FIG. 6 and the temporary coupled state in which the front barrel is slightly pushed in.

In the virgin state, the applicator is maintained in the initial coupled state in which the front barrel 26 is held by the stopper ring 34 and temporarily coupled to the barrel cylinder 10 (see FIG. 1).

To start using, first, the user removes the stopper ring 34 and sets the front barrel 26 into a state (initial coupled state) in which the front barrel 26 is not pushed toward the barrel cylinder 10 side. In this case, as shown in FIG. 1, the front rib 54 of the front barrel 26 abuts, or is positioned in front of, the temporary coupling portion 44 of the barrel cylinder 10, and the rear rib 56 is positioned and sunk between the front and rear elements of the full coupling portion 42 (the fitting elements 42F and 42R). In the initial coupled state, the front rib 54 of the temporary coupling portion of the front barrel 26 and the temporary coupling portion 44 of the barrel cylinder are in a state before the temporary coupled state. Further, the seal ball 36*a* is embedded in the seal joint 36. The anti-rotation ribs 46 of the barrel cylinder 10 are not engaged with the anti-rotation ribs 38 of the front barrel 26. Therefore, the front barrel 26 can freely rotate with respect to the barrel cylinder 10. The rear rib 56 of the front barrel 26 is sunk between the front and rear elements in the full coupling portion 42 (full coupling elements 42F, 42R), but the anti-rattling portion 50 of the ribs for preventing rattling between the full coupling elements 42F and 42R, supports the rear rib 56 of the front barrel 26, so that rattling of the front barrel 26 can be prevented.

In preparation for use, the front barrel 26 is slightly pushed into the barrel cylinder 10 from the initial coupled state to reach the temporary coupled state shown in FIG. 7. In this case as well, the front rib 54 of the front barrel 26 is positioned in contact with the temporary coupling portion 44 of the barrel cylinder 10. The anti-rattling portion 50 supports the rear rib of the front barrel 26 to prevent rattling. In this state, the anti-rotation ribs 38 of the front barrel 26 are inserted into and engaged with the anti-rotation ribs 46 of the barrel cylinder 10, whereby the front barrel 26 and the barrel cylinder 10 are prevented from rotating with each other.

Then, when the front barrel 26 is pushed in from the temporary coupled state of FIG. 7, the front rib 54 climbs over the full coupling element 42F on the front side from the temporary coupling portion 44 and becomes engaged with the full coupling element 42F, whereas the rear rib 56 climbs over and becomes engaged with the full coupling element 42R. In this way, the fully coupled state shown in FIG. 6 is achieved. The front barrel 26 moves in the axial direction by the substantial length of the stopper ring 34, and is set into the fully coupled state in which the front barrel 26 is directly fitted in the barrel cylinder 10. At the same time, the anti-rotation ribs 38 of the front barrel 26 are completely inserted into the anti-rotation ribs 46 of the barrel cylinder 10, so that rotation of the barrel cylinder 10 with respect to the front barrel 26 can be more reliably prevented.

According to the applicator of the embodiment, the full coupling portion 42 (42F, 42R) and the temporary coupling portion 44 are formed on the barrel cylinder 10 while the front rib 54 for temporary coupling with the temporary coupling portion 44 in the front end portion 10*a* of the barrel cylinder 10 and the front rib 54 and the rear rib 56 for full coupling with the full coupling portion 42 (42F, 42R) of the front end portion 10*a* are formed substantially entirely around the inner circumference of the front barrel 26. The barrel cylinder 10 has anti-rotation ribs 46 while the front barrel 26 has anti-rotation ribs 38.

As shown in FIG. 1, in the initial coupled state before the temporarily coupled state of the barrel cylinder 10 and the front barrel 26 (before the temporary coupling portion 44 and the front rib 54 are engaged with each other), the anti-rotation ribs 46 and 38 are not mutually engaged, that is, are in a relatively rotatable state.

On the other hand, as shown in FIG. 7, in the temporarily coupled state (the temporary coupling portion 44 and the front ribs 54 are engaged with each other), the anti-rotation ribs 46 and 38 are engaged with each other, resulting in a rotation detent state.

Further, as shown in FIG. 6, the front barrel 26 and the barrel cylinder 10 are connected by being in the fully coupled state (the full coupling portion 42 (42F, 42R) and the front rib 54 and the rear rib 56 are connected to each other), so that the applicator becomes ready for use.

Thus, in the case a user removes the front barrel 26 in addition to the stopper ring 34 at the start of use, the anti-rotation ribs 46 and 38 become engaged with each other, so that press-fitting without misalignment is possible when the front barrel 26 is refitted and fully coupled. Therefore, it is possible to prevent liquid leakage due to insufficient press-fitting.

Further, the anti-rotation ribs 46 of the barrel cylinder 10 and the anti-rotation ribs 38 of the front barrel 26 are engaged with each other so as to create an anti-rotation state between the barrel cylinder 10 and the front barrel 26. Therefore, it is possible to prevent the application body 24, which is a brush or a bundle of fibers, from being twisted when the user turns the front barrel 26.

Further, since the temporary pulling force (pulling force when the stopper ring 34 is present) in the initial coupled state can be strengthened, the front barrel 26 can be prevented from falling off from the barrel cylinder 10 during transportation and other occasions.

Here, Table 1 shows the pulling force of the samples A to F (each n=5) of conventional products in the initial coupled state.

TABLE 1

| | Pulling force (N) | | |
|---|---|---|---|
| | Ave | Max | Min |
| Sample A | 1.7 | 1.9 | 1.4 |
| Sample B | 3.7 | 5.8 | 3.0 |
| Sample C | 2.4 | 2.7 | 2.1 |
| Sample D | 3.0 | 3.3 | 2.6 |
| Sample E | 4.2 | 4.5 | 3.7 |
| Sample F | 5.1 | 6.0 | 4.0 |

In comparison with that, in the initial coupled state with the applicator of the embodiment, the pulling force (n=5) obtained was 17.6 (N) at the average value (Ave) and 20.0 (N) at the maximum value (Max), and 14.3 (N) at the minimum value (Min). This result lets it be understood that a strong force is required for pulling so that it is possible to effectively prevent the front barrel from falling off even if vibration occurs during transportation, etc.

INDUSTRIAL APPLICABILITY

The applicator of the present invention can be used as a cosmetic applicator for cosmetic products etc., an applicator for chemical solution, and the like.

EXPLANATION OF SYMBOLS

10 barrel cylinder
10*a* front end portion
10*b* storage portion
10*c* stepped portion
10*d* stirring piece
10*e* fitting portion
10*f* longitudinal rib
12 piston
12*a* main body
12*b* sealing portion
14 screw shaft
14*a* threaded portion
14*b* fitting portion
14*c* cutout
16 rotary cam body
16*a* cam
16*b* cam
16*c* internal through hole
16*c*1 protrusion

18 transmission cam body
18*a* cam
18*b* protrusion
18*c* spring
20 propelling body
20 guide slot
20*b* protrusion
20*b*1 arm portion
20*c* guide portion
20*c*1 stepped portion
22 screw body
22*a* cylindrical portion
22*a*1 window
22*a*2 rib
22*a*3 inclined surface (thin-walled part)
22*a*31 step
22*b* threaded portion
24 application body
24*a* flange
26 front barrel
28 cap
30 pipe joint
32 pipe
34 stopper ring
36 seal joint
36*a* seal ball
36*b* small-diametric portion
36*c* projected portion
36*d* flange
38 anti-rotation rib of the front barrel
42 full coupling portion
44 temporary coupling portion
46 anti-rotation rib of the barrel cylinder
50 anti-rattling portion
54 front rib
56 rear rib

The invention claimed is:

1. An applicator which comprises: a barrel cylinder in which an application liquid is stored in a storage portion inside a rear part thereof; and an application body arranged inside a front part of the barrel cylinder wherein the application body is supplied with the application liquid stored in the storage portion in the barrel cylinder, characterized in that:

a full coupling portion and a temporary coupling portion are formed on each of a front barrel and the barrel cylinder;

the front barrel and the barrel cylinder each have an anti-rotation rib;

the anti-rotation ribs are not engaged with each other in an initial coupled state, before a temporary coupled state, in which the temporary coupling portions of the barrel cylinder and the front barrel are engaged with each other; and, the anti-rotation ribs become engaged with each other in a fully coupled state in which the full coupling portions are engaged with each other, wherein a seal ball is fitted in a front end portion of the barrel cylinder via a seal joint, and in the fully coupled state the seal ball is held in the storage portion of the barrel cylinder, and the seal joint in which the seal ball is fitted in, is formed with a projected portion projecting from a rear end opening thereof.

2. The applicator according to claim 1, wherein the temporary coupling portion formed on the barrel cylinder is formed on an application body side of the full coupling portion of the barrel cylinder.

3. The applicator according to claim 2, wherein the barrel cylinder is formed with an anti-rattling portion that radially supports the front barrel from an inside, at least, at the time of either the initial coupled state or the temporary coupled state.

4. The applicator according to claim 3, wherein the full coupling portion of the barrel cylinder has different outside diameters at the front side and the rear side thereof.

5. The applicator according to claim 1, further comprising: a piston that slides inside the storage portion; a screw shaft threaded on a peripheral surface thereof; a propelling body for a propelling operation; a rotary cam body; and a transmission cam body, wherein a threaded portion mating the screw shaft is provided in a rear of the storage portion, the rotary cam is turned by a propelling operation on the propelling body so as to relatively rotate the screw shaft and the threaded portion to thereby advance the screw shaft, which in turn advances the piston to supply the application body with the application liquid stored in the storage portion, and at least one of the screw shaft, the rotary cam body, and the transmission cam body is formed symmetrically with respect to a front-rear direction.

6. The applicator according to claim 5, wherein a screw body is formed with a threaded portion for accommodating the rotary cam body, the transmission cam body and the propelling body, the screw body having an inclined surface whose diameter increases from a rear end toward a front, formed on an inner surface thereof.

7. The applicator according to claim 6, wherein: a relative rotation between the rotary cam body and the screw shaft is restricted; the transmission cam body rotates the rotary cam body by the propelling operation on the propelling body; the screw body formed with the threaded portion mating the screw shaft is provided in a rear of the storage portion; and, by the operation of the propelling body the rotary cam body rotates to advance the piston to supply the application liquid stored in the storage portion to the application body.

8. The applicator according to claim 1, wherein the application liquid is an oil-based cosmetic liquid stored in the barrel cylinder, and the barrel cylinder is made of PBT.

* * * * *